US011721173B2

(12) United States Patent
Tran et al.

(10) Patent No.: US 11,721,173 B2
(45) Date of Patent: Aug. 8, 2023

(54) GAMING MACHINE HAVING A JACKPOT RESULTING FROM PLAYER SELECTION OF A PLURALITY OF SELECTABLE ICONS

(71) Applicant: Aristocrat Technologies Australia Pty Limited, North Ryde (AU)

(72) Inventors: Dinh Toan Tran, Wetherill Park (AU); Oliver Crispino, Rosemeadow (AU); Upinder Dhaliwal, Schofields (AU); Nicholas O'Sullivan, Beacon Hill (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 229 days.

(21) Appl. No.: 17/187,403

(22) Filed: Feb. 26, 2021

(65) Prior Publication Data

US 2021/0183207 A1 Jun. 17, 2021

Related U.S. Application Data

(63) Continuation of application No. 16/144,669, filed on Sep. 27, 2018, now Pat. No. 10,957,160.

(30) Foreign Application Priority Data

Sep. 28, 2017 (AU) ..... 2017903936

(51) Int. Cl.
*G07F 17/32* (2006.01)

(52) U.S. Cl.
CPC ..... *G07F 17/3267* (2013.01); *G07F 17/323* (2013.01); *G07F 17/3213* (2013.01); *G07F 17/3258* (2013.01)

(58) Field of Classification Search
CPC ..... G07F 17/323; G07F 17/3267
See application file for complete search history.

(56) References Cited

U.S. PATENT DOCUMENTS

| | | | |
|---|---|---|---|
| 4,448,419 | A | 5/1984 | Telnaes |
| 5,605,506 | A | 2/1997 | Hoorn |
| 6,910,964 | B2 | 6/2005 | Acres |

(Continued)

OTHER PUBLICATIONS

Office Action dated Jul. 21, 2020 for U.S. Appl. No. 16/144,669 (pp. 1-9).

(Continued)

*Primary Examiner* — Corbett B Coburn
(74) *Attorney, Agent, or Firm* — Armstrong Teasdale LLP

(57) ABSTRACT

An electronic gaming machine includes a game controller that executes instructions stored in a memory which cause the game controller to display, on a display of the gaming machine, a plurality of jackpots and a plurality of bonus meters. The instructions also cause the game controller to display, on the display, a plurality of player selectable symbols and to receive a player selection of at least one of the player selectable symbols. In response to receiving the player selection, the selected a jackpot symbol is revealed in place of the selected player selectable symbol, and the game controller adds a prize amount to the bonus meter of the jackpot corresponding to the revealed jackpot symbol. When at least a predefined number of jackpot symbols are revealed, both of a value of the jackpot corresponding to the jackpot symbols and an accumulated value of the associated bonus meter are awarded to a player.

20 Claims, 31 Drawing Sheets

(56) References Cited

U.S. PATENT DOCUMENTS 7,384,335 B2 6/2008 Boyd
7,530,892 B2 5/2009 Jordan
7,547,252 B2 6/2009 Peterson
7,607,976 B2 10/2009 Baerlocher
7,699,699 B2 4/2010 Gilliland
7,806,760 B2 10/2010 Baerlocher
8,720,890 B1 * 5/2014 D'Avanzo ..... G07F 17/3267 273/139
10,957,160 B2 * 3/2021 Tran ..... G07F 17/3267
2004/0137978 A1 7/2004 Cole
2004/0204226 A1 * 10/2004 Foster ..... G07F 17/3262 463/20
2005/0215325 A1 * 9/2005 Nguyen ..... G07F 17/3202 463/16
2006/0172792 A1 8/2006 Vancura
2006/0205468 A1 * 9/2006 Saffari ..... G07F 17/32 463/16
2006/0229124 A1 10/2006 Walker
2008/0161081 A1 7/2008 Berman
2010/0004059 A1 * 1/2010 Kopera ..... G07F 17/3211 463/30
2010/0016073 A1 * 1/2010 Goldstein ..... G07F 17/32 463/43
2010/0173704 A1 * 7/2010 Cole ..... G07F 17/32 463/30
2011/0092268 A1 * 4/2011 Vann ..... G07F 17/3202 463/20
2011/0190043 A1 8/2011 San
2012/0129601 A1 * 5/2012 Gronkowski ..... G07F 17/3239 463/31
2012/0178523 A1 * 7/2012 Greenberg ..... G07F 17/3211 463/25
2012/0178528 A1 * 7/2012 Brunell ..... G07F 17/34 463/31
2013/0065665 A1 3/2013 Watkins
2013/0150157 A1 * 6/2013 Losser ..... G07F 17/3211 463/31
2013/0184078 A1 * 7/2013 Brunell ..... G07F 17/3211 463/43
2014/0087887 A1 * 3/2014 Chudek ..... G07F 17/3202 463/46
2014/0235324 A1 * 8/2014 Ryan ..... G07F 17/3213 463/21
2014/0335937 A1 * 11/2014 Brunell ..... G07F 17/3258 463/31
2014/0335956 A1 * 11/2014 Brunell ..... G07F 17/3225 463/31
2015/0080117 A1 3/2015 Czyzewski
2015/0087404 A1 * 3/2015 Lesley ..... G07F 17/3246 463/25
2016/0292955 A1 * 10/2016 Gronkowski ..... G07F 17/3269
2018/0089932 A1 3/2018 Hase
2019/0096188 A1 * 3/2019 Tran ..... G07F 17/3258
2020/0118392 A1 * 4/2020 Furlong ..... G07F 17/3267

OTHER PUBLICATIONS

Notice of Allowance dated Nov. 19, 2020 for U.S. Appl. No. 16/144,669 (pp. 1-9).

* cited by examiner

GAMING MACHINE HAVING A JACKPOT RESULTING FROM PLAYER SELECTION OF A PLURALITY OF SELECTABLE ICONS

CROSS-REFERENCE TO RELATED APPLICATIONS

This application is a continuation of and claims priority to U.S. patent application Ser. No. 16/144,669, filed Sep. 27, 2018, now U.S. Pat. No. 10,957,160, which claims priority to Australian Patent Application No. 2017903936, filed Sep. 28, 2017, the entire contents of which are incorporated herein by reference in their entireties.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

In one aspect, an electronic gaming machine is provided. The electronic gaming machine includes a display device and a game controller. The game controller executes instructions stored in a memory which cause the game controller to display, on the display device, a plurality of jackpots and a plurality of bonus meters, where each bonus meter corresponds to and is displayed in association with one of the jackpots. The instructions also cause the game controller to display, on the display device, a plurality of player selectable symbols and receive a player selection of at least one of the player selectable symbols. Further, the instructions cause the game controller to reveal, in response at least in part to receiving the player selection, a jackpot symbol in place of the selected player selectable symbol, where the jackpot symbol corresponds to one of the plurality of jackpots. In addition, the instructions cause the game controller to add a prize amount to the bonus meter of a jackpot corresponding to the revealed jackpot symbol, and award, when at least a predefined number of jackpot symbols corresponding to the jackpot are displayed, both of a value of the jackpot and an accumulated value of the bonus meter of the jackpot.

In another aspect, a method of displaying a wagering game on an electronic gaming machine is provided. The method includes displaying, by a game controller and on a display device of the electronic gaming machine, a plurality of jackpots and a plurality of bonus meters, where each bonus meter corresponds to and is displayed in association with one jackpot of the plurality of jackpots. The method also includes displaying, by the game controller and on the display device, a plurality of player selectable symbols, and receiving a player selection of a player selectable. Further, the method includes revealing, by the game controller and in response at least in part to receiving the player selection, a jackpot symbol in place of the selected player selectable symbol, where the jackpot symbol corresponds to one of the plurality of jackpots, and adding, by the game controller and in response to revealing the jackpot symbol, a prize amount to the bonus meter of a jackpot corresponding to the jackpot symbol. In addition, the method includes awarding, by the game controller and when at least a predefined number of jackpot symbols corresponding to the jackpot are revealed, both of a value of the jackpot and an accumulated value of the bonus meter of the jackpot.

In yet another aspect, a gaming system is provided. The gaming system includes an electronic gaming machine and a server system communicatively coupled to the electronic gaming machine. The server system includes a processor that executes instructions stored in a memory which cause the processor to display, on a display device of the electronic gaming machine, a plurality of jackpots and a plurality of bonus meters, where each bonus meter corresponds to and is displayed in association with one of the jackpots. The instructions also cause the processor to display, on the display device of the electronic gaming machine, a plurality of player selectable symbols and to receive a player selection of at least one of the player selectable symbols. Further, the instructions cause the processor to reveal, in response at least in part to receiving the player selection, a jackpot symbol in place of the selected player selectable symbol, where the jackpot symbol corresponds to one of the plurality of jackpots. In addition, the instructions cause the processor to add a prize amount to the bonus meter of a jackpot corresponding to the revealed jackpot symbol, and award, when at least a predefined number of jackpot symbols corresponding to the jackpot are revealed, both of a value of the jackpot and an accumulated value of the bonus meter of the jackpot.

BRIEF DESCRIPTION OF THE DRAWINGS

An exemplary embodiment of the disclosure will now be described with reference to the accompanying drawings in which.

DETAILED DESCRIPTION

Figure 1:
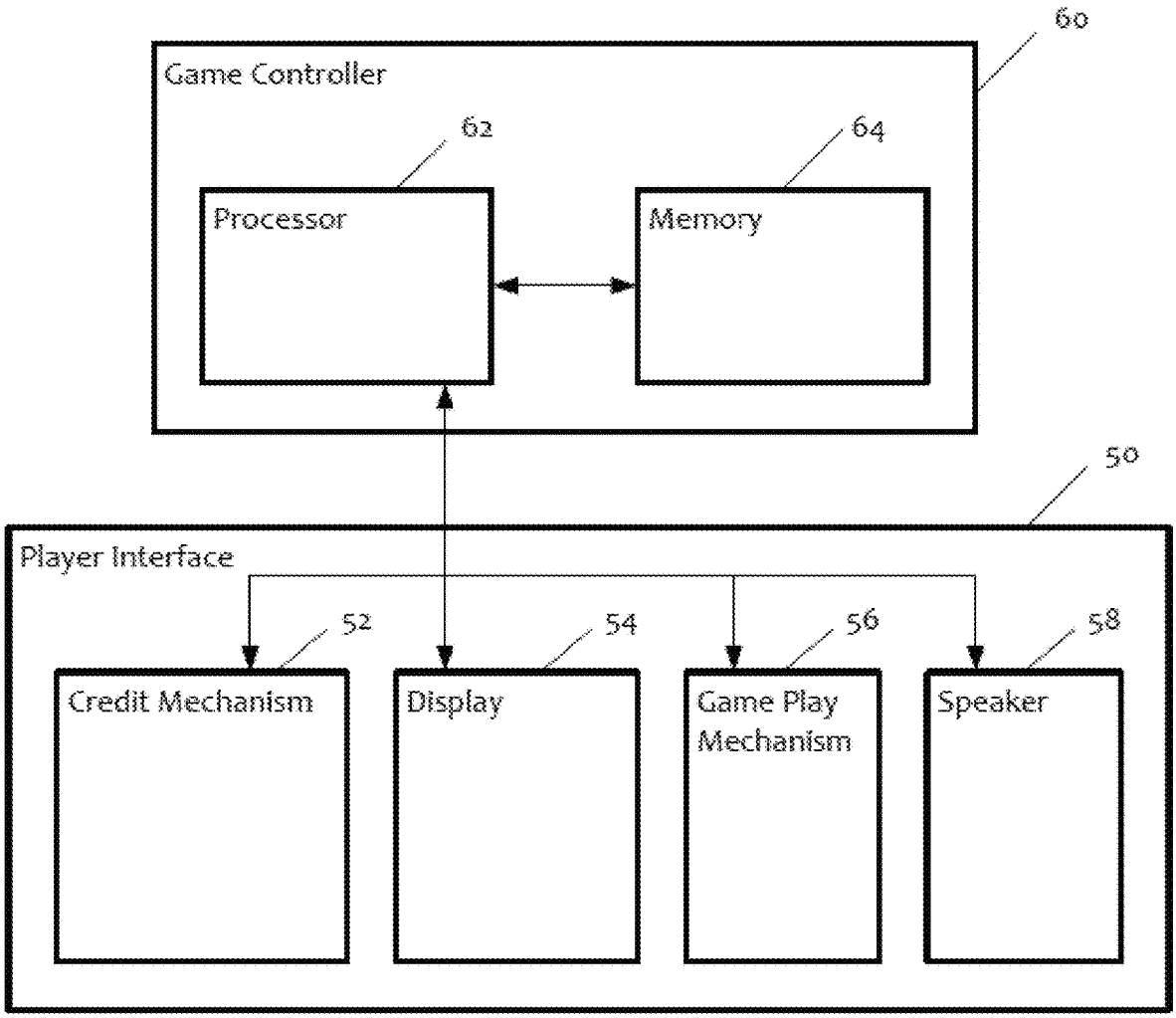
FIG. 1 is a block diagram of a plurality of core components of an exemplary gaming machine.

Referring to the drawings, there is shown a gaming machine having a number of novel features.

In one aspect, the gaming machine has bonus meters associated with specific jackpot prizes to enable the gaming machine to implement a pick a box type feature game where additional awards are tracked in respect of at least a subset of the jackpot prizes. In this respect, bonus meters are associated with at least some of the jackpot prizes and when a player makes a selection of a box which results in the revealing of a jackpot symbol corresponding to that particular jackpot prize, a bonus meter associated with the jackpot prize is updated by adding a prize amount. When a player wins a particular jackpot prize that has an associated bonus meter, both the prize stored in the bonus meter and the jackpot prize are awarded by the game controller to a win meter or a credit meter.

In another aspect, the embodiments may employ graphic assets that correspond to respective turn over states which change as turnover increases. These graphic assets provide a visual indicator to the player of the turnover since the last awarding of the relevant jackpot prize. The gaming machine is configured so that the graphic assets are only updated when a designated symbol appears even though the turnover may have already moved into a range corresponding to another the relevant jackpot asset. Further, the gaming controller is configured to inhibit the change to the next graphic in the range if a jackpot feature is awarded.

In another aspect, the gaming machine incorporates edge lighting which is controlled by the gaming machine in response to game events. The gaming machine monitors for occurrences of game events and controls the edge lighting in accordance with a lighting configuration associated with the specific game event.

In an embodiment, the edge lighting is divided into a number of sections corresponding the number of trigger symbols required to trigger a feature game. The sections are lit up each time a trigger symbol appears on the display to communicate the status of the trigger to the player and/or others watching the players play the gaming machine.

In yet another aspect, the gaming machine incorporates an expanding wild feature where a random determination is conducted to determine whether an expansion condition is met. In embodiments, where more than one designated symbol is selected by the gaming machine, the gaming machine is configured either to expand or not expand all the selected designated symbols. The random determination conducted by the gaming machine is configured to be more likely to occur the larger number of designated symbols that are selected.

General Construction of Gaming Machine

The gaming machine can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming machine has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58. In various embodiments, game play mechanism may also be referred to as a "player input interface," which may include, for example, one or more mechanical pushbuttons, one or more software or virtual buttons, a "button deck" that includes a plurality of mechanical and/or virtual buttons, and the like.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer to any device that can process or execute one or more computer-readable or computer-executable instructions, such as instructions stored in a computer memory, as described herein, In various embodiments, a processor may include: a microprocessor, microcontroller, programmable logic device and/or any other computational device, such as a computer (e.g. a PC, a laptop computer, a tablet computing device, a smartphone), a server computer, and the like. Accordingly, in at least some embodiments, a processor may be provided by any suitable logic circuitry for receiving inputs, processing or executing them in accordance with instructions stored in memory and generating outputs (for example on the display). In some embodiments, a processor may include a central processing unit (or CPU). In some embodiments, a processor may include an integrated circuit, such as, for example, an application specific integrated circuit (ASIC) or a field programmable gate array (FPGA).

Figure 2A:
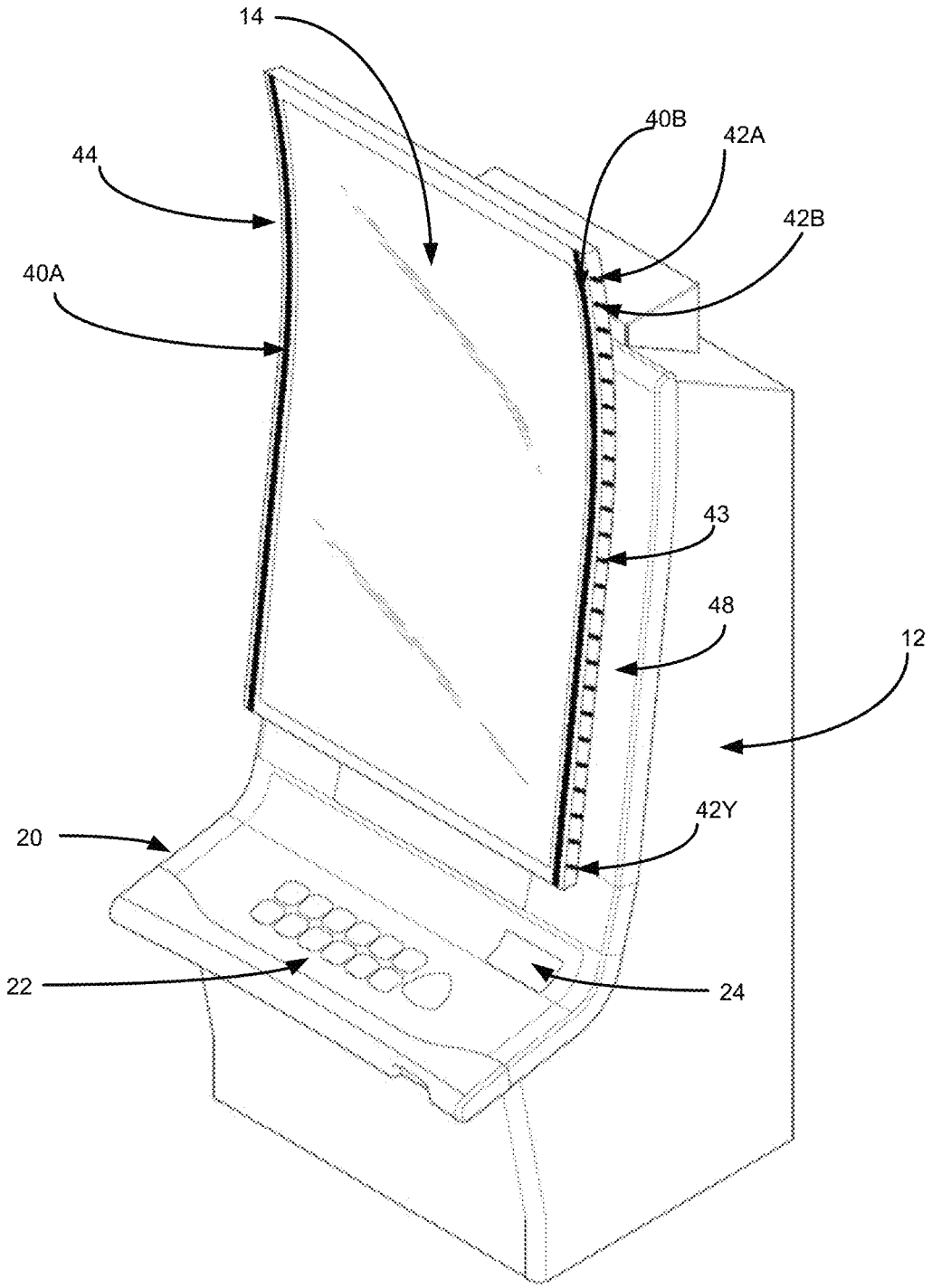
FIG. 2A is a front perspective view of an exemplary gaming machine.
Figure 2B:
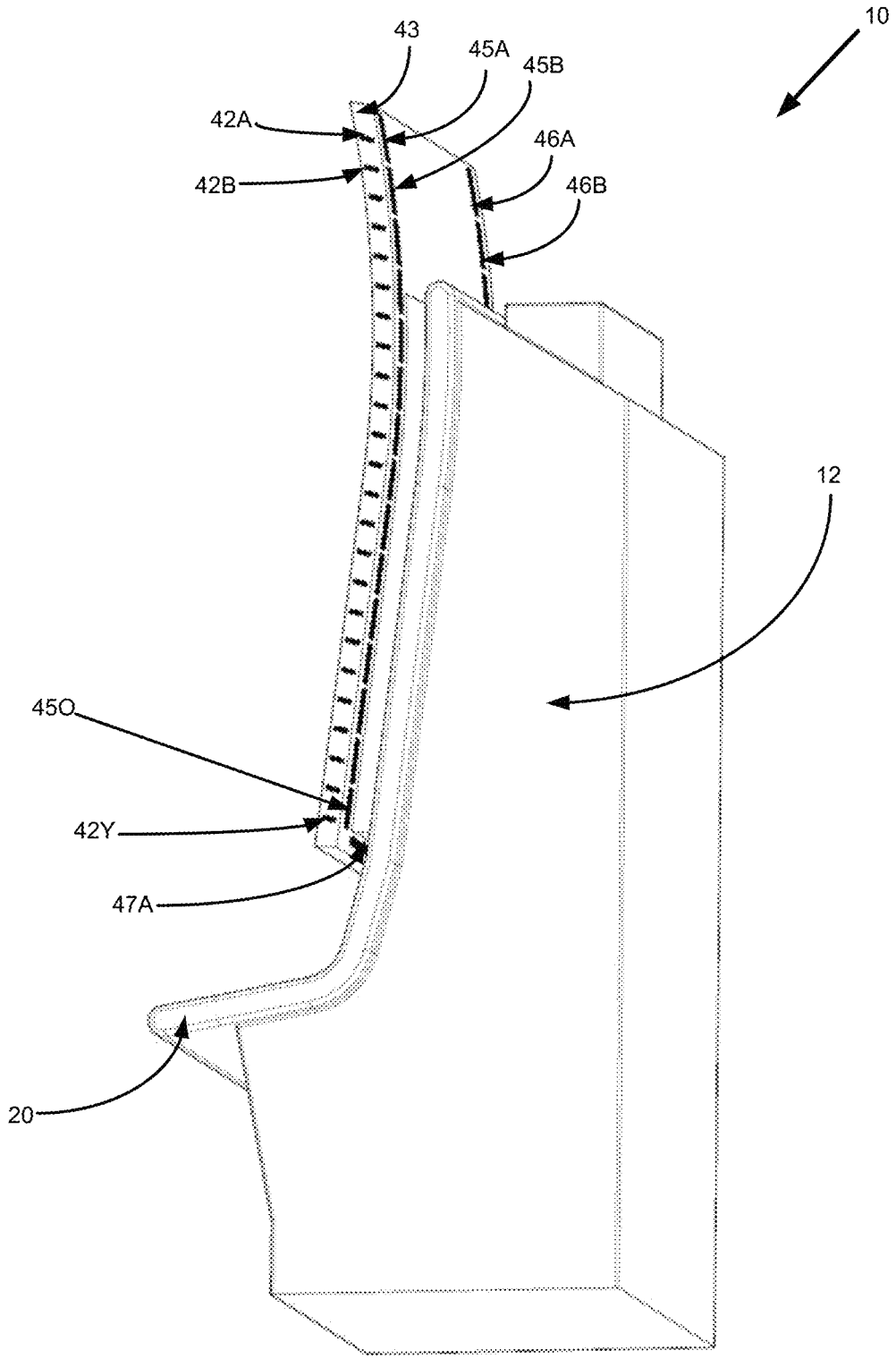
FIG. 2B is a rear perspective view of an exemplary gaming machine.

A standalone gaming machine 10 is illustrated in FIGS. 2A and 2B. The gaming machine 10 includes a cabinet 12 having a display 14 on which are displayed representations of a game that can be played by a player. The display appears to be a single display from the perspective of the player but is actually formed from two LCDs, an upper curved LCD and a lower, flat LCD. In other embodiments, the display can be formed from two flat LCDs, two curved LCDs, a single LCD, and the like. A mid-trim 20 of the gaming machine 10 houses a bank of buttons 22 for enabling a player to interact with the gaming machine, in particular during game play. The mid-trim 20 also houses a credit input mechanism which includes a bill acceptor/validator/ticket reader 24. In some embodiments, the credit input mechanism may also include at least one of a card reader and/or a coin input mechanism.

The display 14 may be any other suitable video display unit, such as an OLED display. In other embodiments, a further display can be mounted above display 14, such as, for example, to show the progress of a linked jackpot.

The gaming machine incorporates a number of lights 40, 42, 45, and 47. Referring to FIG. 2A, these lights include left and right side strip lights 40A, 40B. The gaming machine also has edge lighting provided by a series of twenty-five side slots 42A, 42B . . . 42Y in the right hand edge 43, which allow light to escape from light sources within the right had edge 43 of the gaming machine corresponding, at least in number, to the number of sections it is desired to be able to light independently. A corresponding set of slots are provided in the left hand edge 44 of the gaming machine 10. Referring now to FIG. 2B, there are also a set of 15 rear side lights, 45A, 45B . . . 450 in the right rear side with corresponding lights 46A, 46B, etc. in the left rear side. Finally, a set of lights 47A, etc. extends along the bottom rear of the display. Advantageously, most of the rear lights 45, 46, 47 cast light onto the front face 48 of the cabinet.

Figure 3:
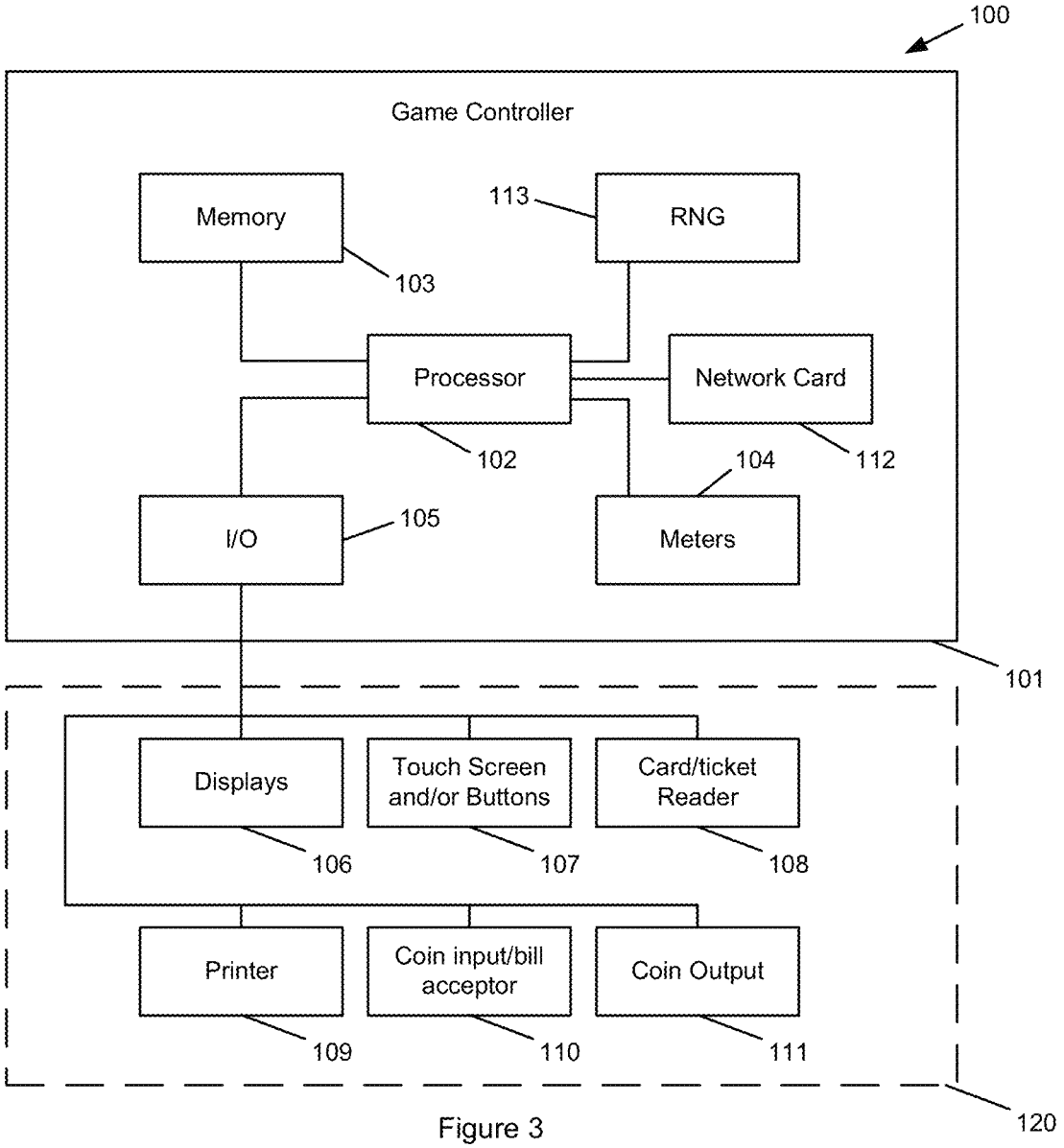
FIG. 3 is a block diagram of a plurality of functional components of an exemplary gaming machine.

FIG. 3 shows a block diagram of operative components of a typical gaming machine which may be the same as or different from the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor/validator and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via the player marketing module—i.e. the player marketing module may be in data communication with one or more of the above devices and communicate with it on behalf of the gaming machine.

Figure 4:
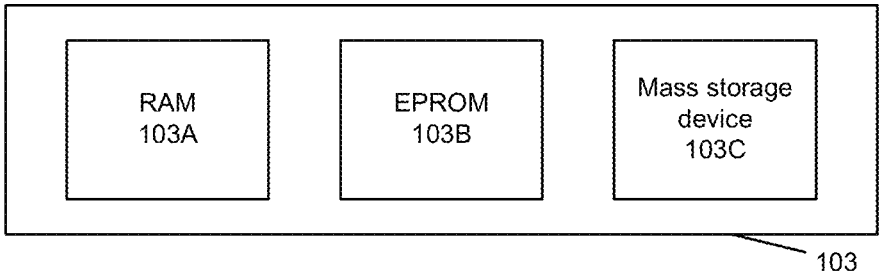
FIG. 4 is a schematic diagram of a plurality of functional components of an exemplary memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/ output devices 106, 107, 108, 109, 110, 111 to be provided remotely from the game controller 101.

Figure 5:
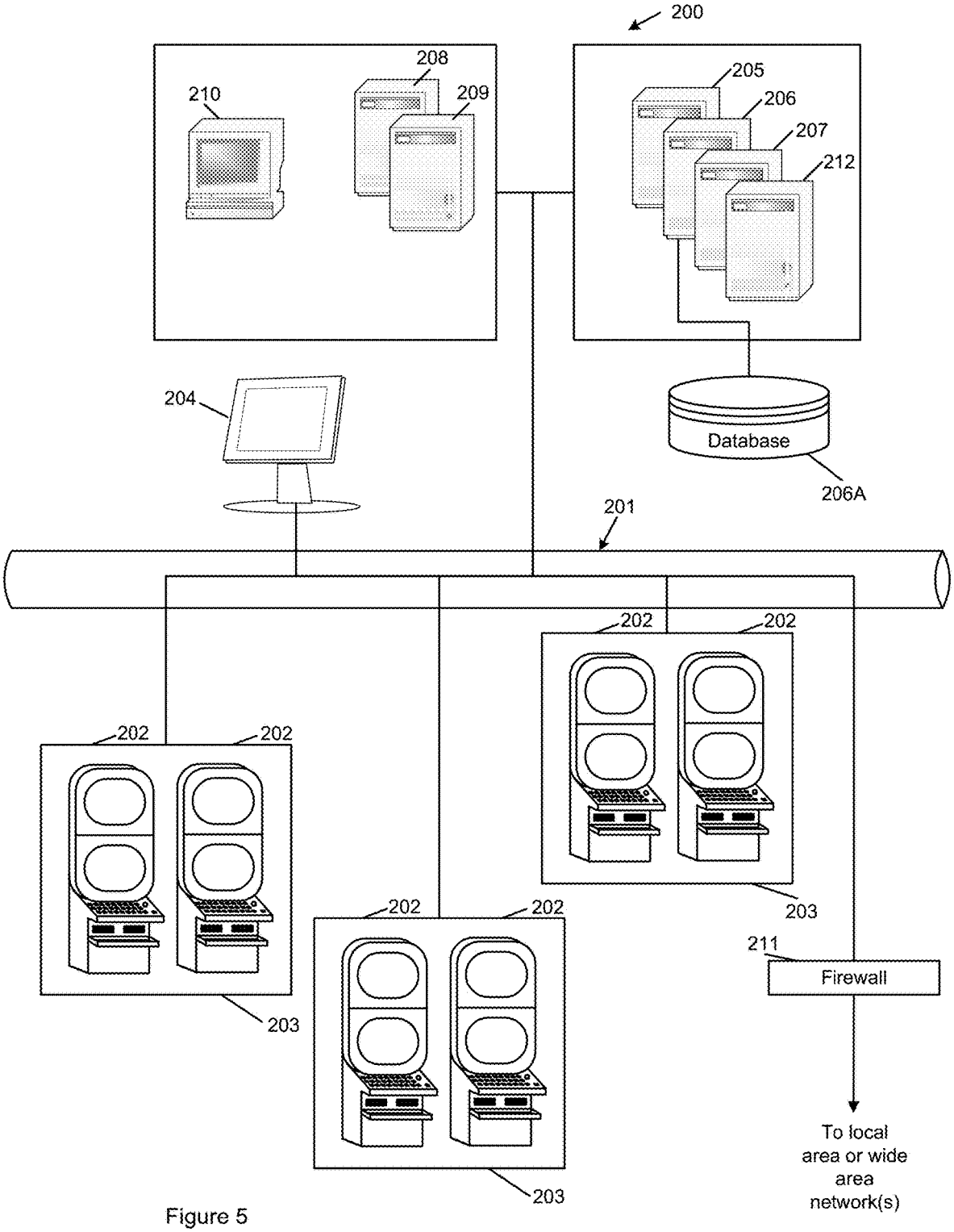
FIG. 5 is a schematic diagram of an exemplary network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a linked Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of the Gaming Machine

The player operates the game play mechanism 56 to specify a wager which will be evaluated for this play of the game and initiates a play of the game. Persons skilled in the art will appreciate that a player's wager can be varied from game to game dependent on player selections.

A number of different wagering mechanisms are used with spinning reel games. For example, a gaming machine may be arranged to enable a player to wager on a number of lines and to choose amount to be wagered per line. The lines are typically formed by a combination of symbol display positions, one from each reel, the symbol display positions being located relative to one another such that they form a line. In many games, the gaming machine may award winning outcomes which are not strictly limited to the lines they have selected, for example, "scatter" pays are awarded independently of a player's selection of pay lines.

In other embodiments, the player may select a number of reels to play or play a fixed number of reels. Games of this type are also known as "ways" to win games.

Embodiments of the disclosure may employ a fixed number of "ways" (the maximum) and enable the player to vary the wager by placing a wager linked to how many "stacks" of symbols will be added to reel strips before each play of the game. Stacks of symbols are typically instances of three or more symbols in a row. Stacks increase the player's chances to win because when the stopping position of a reel includes the stack of symbols it has a higher chance of resulting in winning outcomes.

As the number of "ways" is fixed to the maximum, all symbols selected for each reel can be combined with all symbols of each other reel when evaluated left to right. Thus, the total number of ways to win is determined by multiplying the number of display positions of each reel. As a result for five reels, where three symbols are selected for each reel (i.e. so there are fifteen symbol display positions) there are 243 ways to win. Similarly, for five reels, with four symbols selected per reel, there are 1024 ways to win.

In one embodiment, the display positions of the symbol display are arranged in a rectangular matrix comprising a plurality of columns and a plurality of rows.

Figure 6:
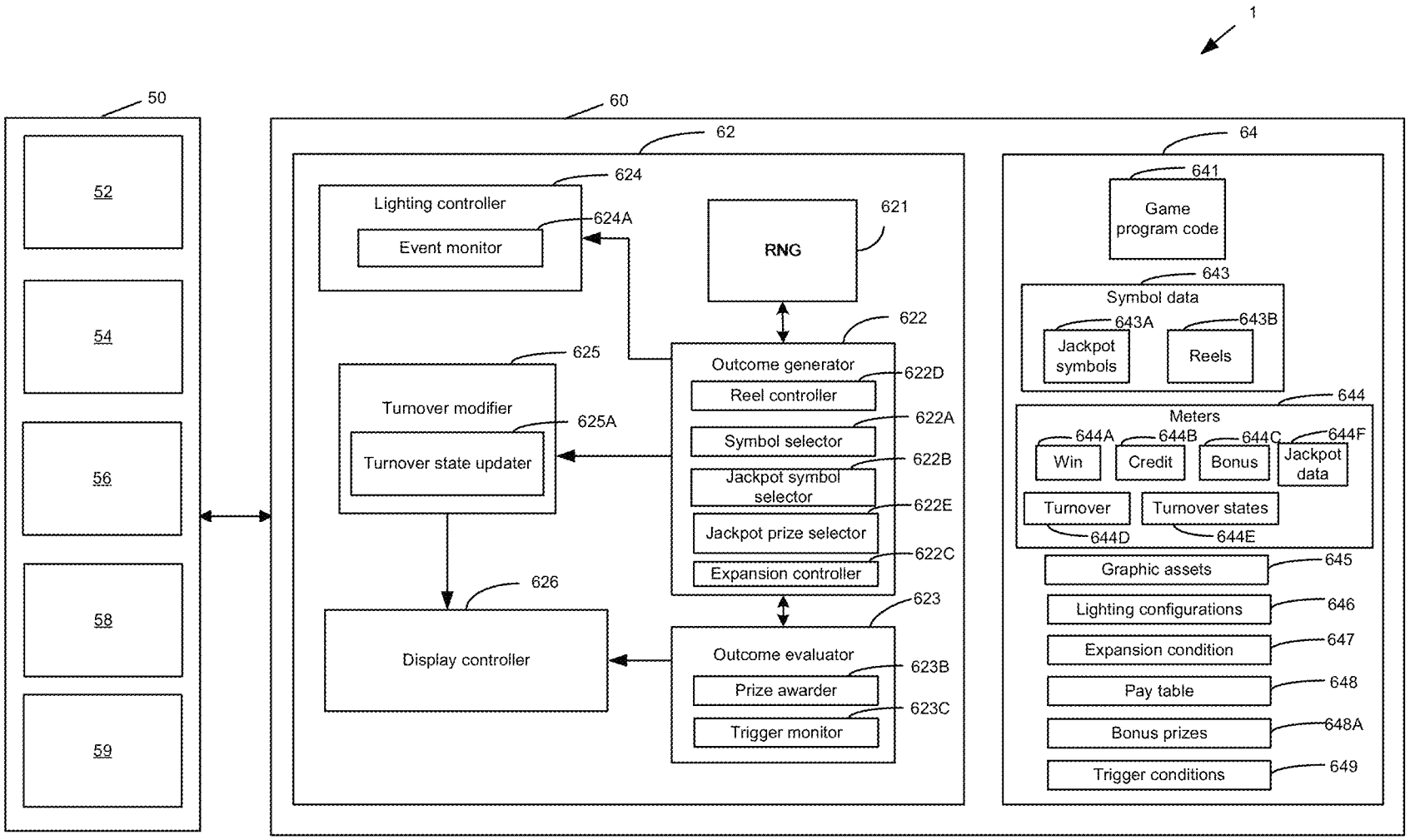
FIG. 6 is a further block diagram of an exemplary gaming machine.

In FIG. 6, the processor 62 of game controller 60 of the gaming machine 1 is shown implementing a number of modules based on program code 641 and data stored in memory 64. Persons skilled in the art will appreciate that one or more of the modules could be implemented in some other way, for example by a dedicated circuit.

When a player initiates a play of the game, the first stage in generating an outcome for the reel controller 622D of outcome generator 622 to control the reels that will be used for this play of the game. To this end, reel controller 622D conducts a determination as to how many stacks of symbols will be added to the reels 643B which is related to the player's wager. In one example, the player's wager affects a number of positions which can be expanded by the reel controller adding a stack of symbols to a base set of reels. In an embodiment, the game reel controller 622D also selects which symbol is added from a weighted table of symbols. Symbol selector 622A then selects stopping positions for each of the reels. For example, five reels arranged in an array where there are four symbols for each reel. That is, there are four symbol positions arranged in five columns set side by side where symbols will be displayed after the stopping positions of the reels have been selected.

The symbols that can be selected for at least two of the reels include a designated symbol in the form of a wild symbol. If the designated symbol is selected, an expansion controller 622C determines whether the wild symbol should be expanded to occupy each position of that reel. In an embodiment, the expansion controller 622C conducts a separate random determination in respect of each wild that appears using random number generator 621. That is, the expansion controller 622C obtains a random number from RNG 621 and if the number is within a defined range as defined by expansion condition 647, then the wild symbol will be expanded to occupy all positions of that reel—i.e. all symbols displayed for that reel will become wild symbols which can substitute for other symbols in winning combinations defined by pay table 648. In the embodiment, the expansion controller 622C is configured so that if an expansion condition is met in respect of any reel that has a wild symbol, all wild symbols of all reels are expanded. Because the expansion controller 622C conducts an independent determination in respect of each wild symbol, the chances of an expansion condition being met increases with the number of wild symbols that are selected. In another embodiment, the expansion controller 622C conducts a single random determination but using different ranges of values depending on the number of wild symbols selected so that the prospects of the expansion condition being met increase depending on the number of wild symbols. In an example, if an expansion condition is met, all symbols on each reel where a wild symbol was displayed are replaced with a gold wild symbol. The outcome evaluator 623 then awards prizes based on pay table 648 taking into account any wild symbols.

The outcome evaluator 623 also includes a trigger monitor 623C which determines whether a respective trigger condition 649 is met for triggering a second screen jackpot feature or a free game feature. If neither of these are triggered, the game ends.

Once the second screen jackpot feature is triggered, the display 54 is changed to show a pick of a box type feature game where the player is presented with a plurality selectable icons. The memory 64 of gaming machine 1 may include jackpot data 644F defining a plurality of jackpot prizes. In an embodiment, some of the jackpot prizes may be fixed while some are progressive. In other embodiments, all the prizes may be fixed or all the prizes may be progressive. In one example, there are grand, major, minor and mini progressive jackpot prizes.

The symbol data 643 includes jackpot symbols 643A corresponding to each of the jackpot prizes, for example, four different jackpot symbols corresponding to the grand, major, minor and mini progressive jackpot prizes. In one example, the meter data 644 includes bonus meter 644C associated with the mini, minor and major jackpot prizes.

A set of possible bonus prizes 648A are stored in a weighted table in memory 64.

When the player selects one of the selectable icons, the jackpot symbol selector 622B uses random generator 621 to select one of the jackpot symbols from a weighted table 643A of jackpot symbols without replacement. That is each entry in the weighted table can only be selected once. The weighting of symbols within the table reflects the relative chances of the player winning the respective jackpots. The jackpot prize selector 622E determines whether a mini, minor or major jackpot symbol is selected, i.e. a symbol corresponding to any prize except the grand jackpot. If one of these symbols was selected, the jackpot prize selector 622E operates to select a bonus prize from the weighted table of bonus prizes 648A.

The selected prize is added to the bonus meter 644C corresponding to a respective jackpot. These bonus meters are displayed on the display during play of the feature game. The process of the player selecting a selectable icon is repeated until the player selects three matching symbols. Then, the prize awarder 623B awards the relevant jackpot prize as stored in jackpot data 644F together with a current bonus meter value of the bonus meter 644C corresponding to the awarded jackpot prize. The award is made by being added to the win meter 644A or the credit meter 644B. The game then reverts back to wherever the position in the game was in when the jackpot feature was triggered. In this respect, in an example, the jackpot feature can be triggered either from the base game or from one game in a series of free games.

In this respect, the series of free games involves a number of free games being awarded based on at least a designated number of scatter symbols that occurring in a game outcome. In the free games, the gaming machine 1 largely operates as in the base game. The free games otherwise proceed as per the base game except that stacks of symbols on a subset of the reels, for example reels two, three and four are changed to gold wild symbols prior to play. The free games feature is described in further detail in relation to FIG. 8.

As indicated above, in one embodiment, the jackpot prizes are progressive prizes. In this embodiment, the current value of each jackpot prize will be dependent on the level of turnover since the jackpot was last awarded. To enable the player to visualize the level of turnover since a jackpot prize was last awarded, the game controller 60 causes the display 54 to display a graphic asset (e.g. an image or an animation) which is indicative of turnover. To this end, the game controller implements a turnover modifier 625 which increments each of the jackpot prizes in jackpot data 644F and which also tracks the total turnover. Memory 64 stores a turnover meter 644D and a current turnover state 644E. In one example, the different turnover states are referred to as different levels as shown in Table 1 below.

TABLE 1

| Level | CREDITS |
|---|---|
| 1 | 0 |
| 2 | 5000 |
| 3 | 10000 |
| 4 | 15000 |
| 5 | 20000 |

The turnover modifier 625 updates the turnover meter 644D based on the wagers input by the player using the game play mechanism. The turnover modifier 625 indicates to the display controller which of the graphic assets 645 should be displayed, for example, on another part of the display of the gaming machine such as a second display. Accordingly, the turnover modifier 625 will initially cause the display controller 626 to display the graphic asset corresponding to the first level.

In an embodiment, each of the levels corresponds to graphic assets which are increasingly large animated piles of coins. The graphic asset which is being displayed is determined by the current turnover state 644E. The gaming machine is configured so that additional conditions must be met in order for the turnover state to be changed by the turnover state updater 625A. That is, turnover value 644D could move from the range corresponding to level one to the range corresponding to level two but the logic implemented by the turnover state updater 625A will only allow the state to be updated (and hence the graphic asset that is displayed to be updated) if certain conditions are met. In an embodiment, the conditions are that a designated symbol appears on the reels without this triggering the jackpot feature. That is, in an embodiment, the transition to the next level only occurs if a wild symbol appears but this does not result in a trigger of the jackpot feature.

In an embodiment, the turnover state updater 625A is configured to reset the graphic asset to the level one asset and the turnover state to level one when a jackpot prize is awarded.

A further feature of the gaming machine 1 of an embodiment is that it incorporates a lighting controller 624 which controls edge lighting 42 on the gaming machine. The edge lighting is divided into a number of sections. In one example, the edge lighting 42 is divided into three sections corresponding to the minimum number of trigger symbols that are needed to trigger the free game series. In an embodiment, a first section of the edge lighting 42 is lit up when a first trigger symbol appears, a second section when a second trigger appears and a third section is lit up when a third trigger symbol appears, each of these being triggered by the event monitor 624A. In another example, the edge lighting 42 is divided into five sections corresponding to a maximum number of trigger symbols. For example, five slots may correspond to a section. In other embodiments, rear side lights 45, 46 may be controlled in a coordinated manner with the edge lights or have common light sources.

The event monitor 624A is also configured to monitor for game events in the form of awarding of the jackpots. In an embodiment, each of the jackpot awards described above have different colors associated with them and the event monitor monitors for the awarding of one of the jackpots and causes the lighting controller 624 to control edge lighting to adopt the color associated with the respective jackpot prize. In some embodiments, each of lights 40, 42, 45, 46, and 47 may be controlled to reflect the jackpot color.

Figure 7:
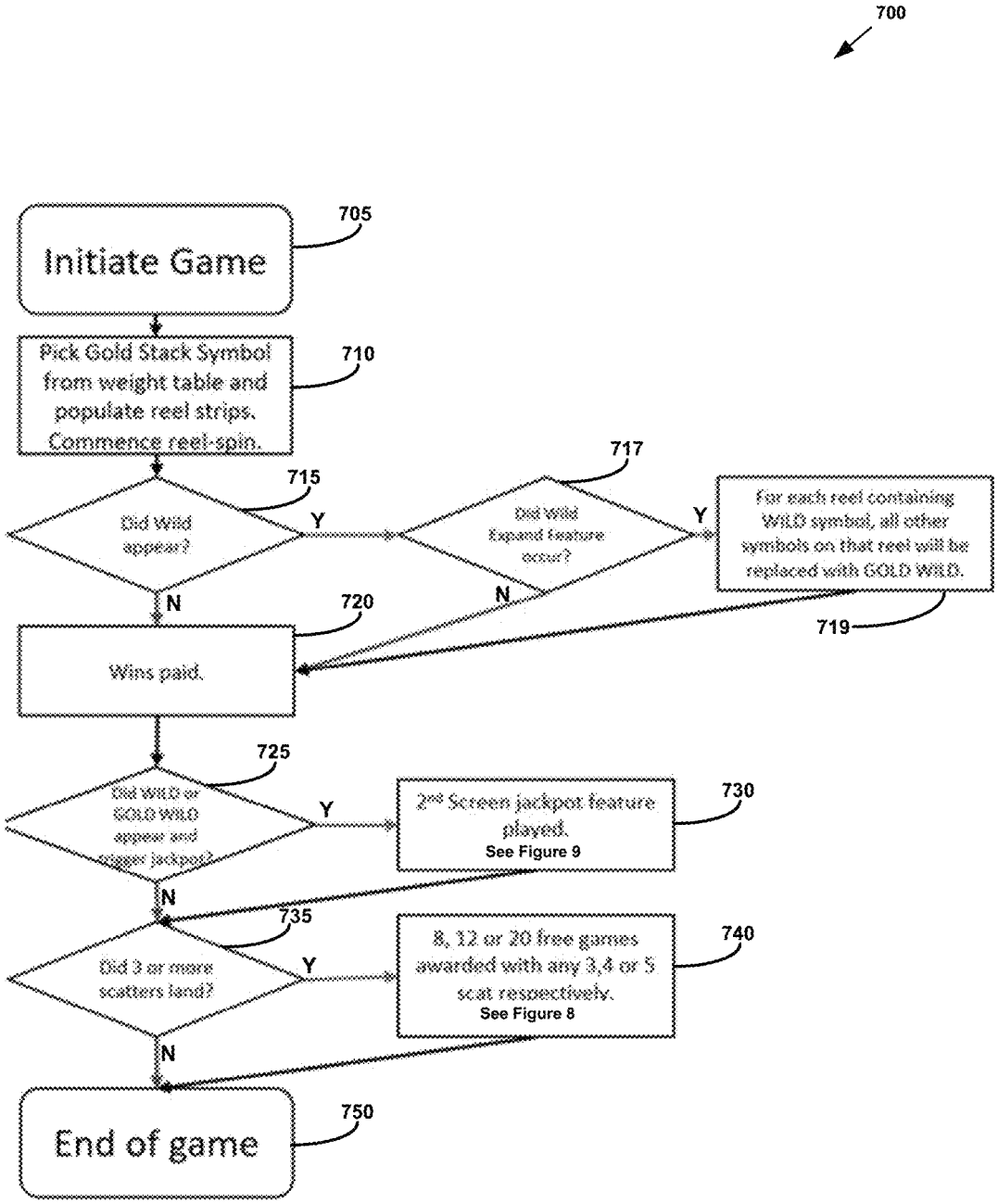
FIG. 7 is a flow chart of a process of gaming, in accordance with at least one embodiment.
Figure 15A:
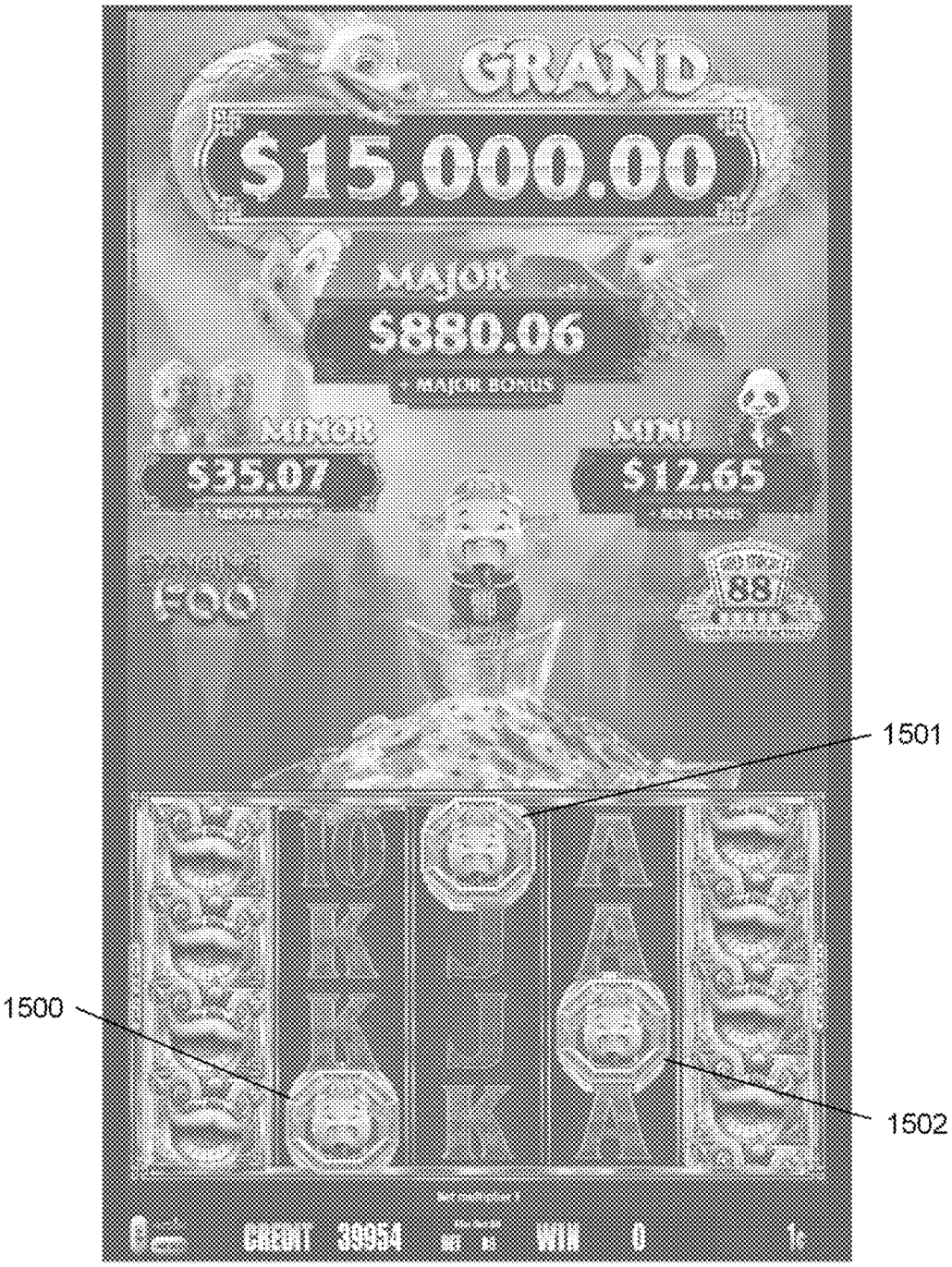
FIGS. 15A and 15B show an example plurality of screenshots of a wild expand event, in accordance with at least one embodiment.

Referring to FIG. 7, there is shown a flow chart of an embodiment. At step 705, the gaming machine receives one or more initiate game instructions via the game play mechanism 56. At step 710, the game controller picks the stack symbol from a weighted table and populates the reel strips with the selected symbol. The game controller also commences the reel spin. At step 715, it is determined whether a wild symbol appears. FIG. 15A shows an example having wild symbols 1500, 1501, 1502 present due to the reel spin; each located in a different column.

Figure 15B:
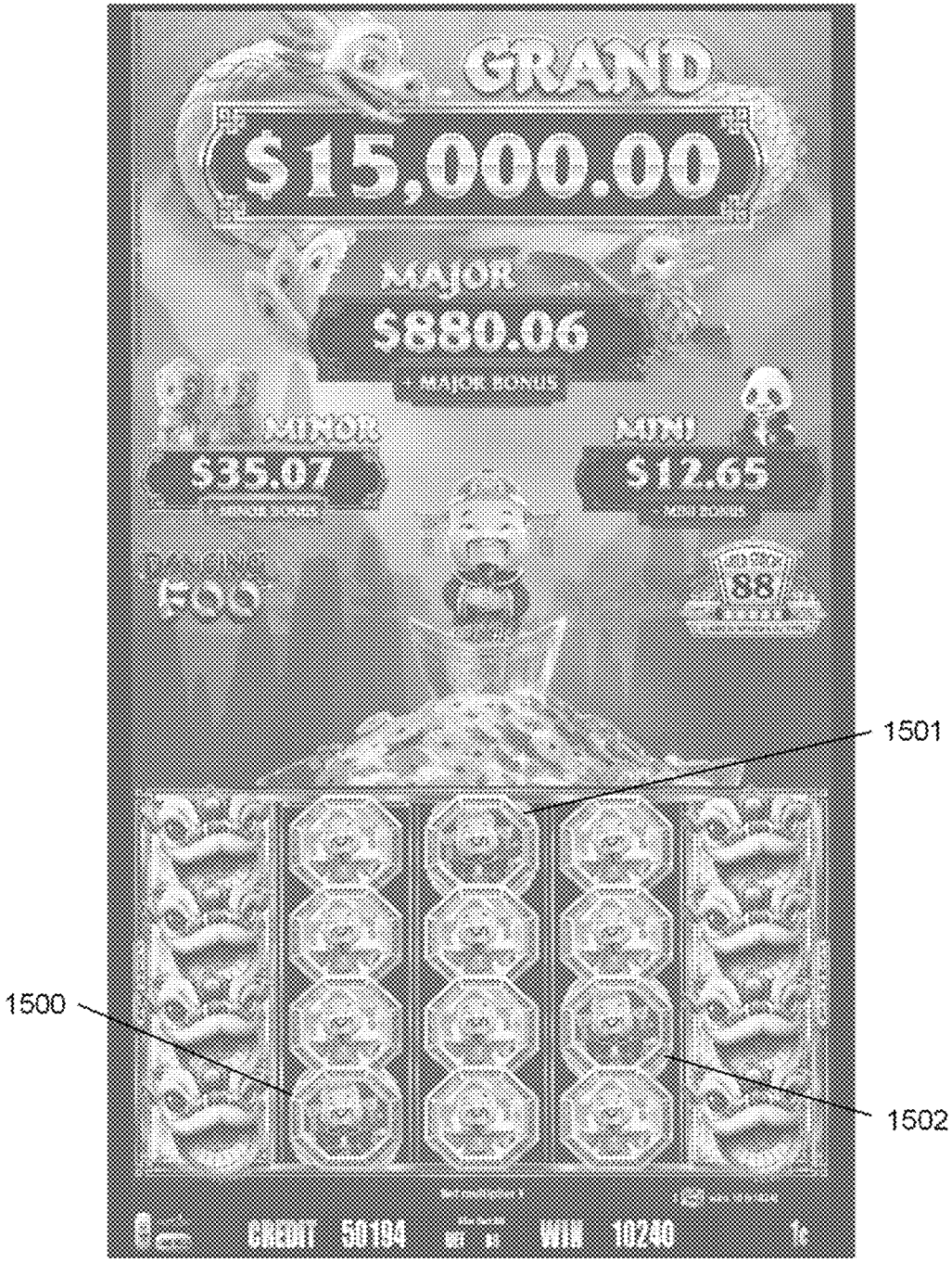

If a wild symbol appears, the game controller conducts, at step 717, a random determination to determine whether the wild expand feature occurs. If the wild expand feature occurs, each reel containing wild symbols has all symbols on that reel replaced with gold wild symbols at step 719. FIG. 15B shows an example where the result of FIG. 15A is modified by replacing non-wild symbols in each column associated with the wild symbols 1500, 1501, 1502 with wild symbols. At step 720, the game controller pays wins based on the pay table 648.

Figure 8:
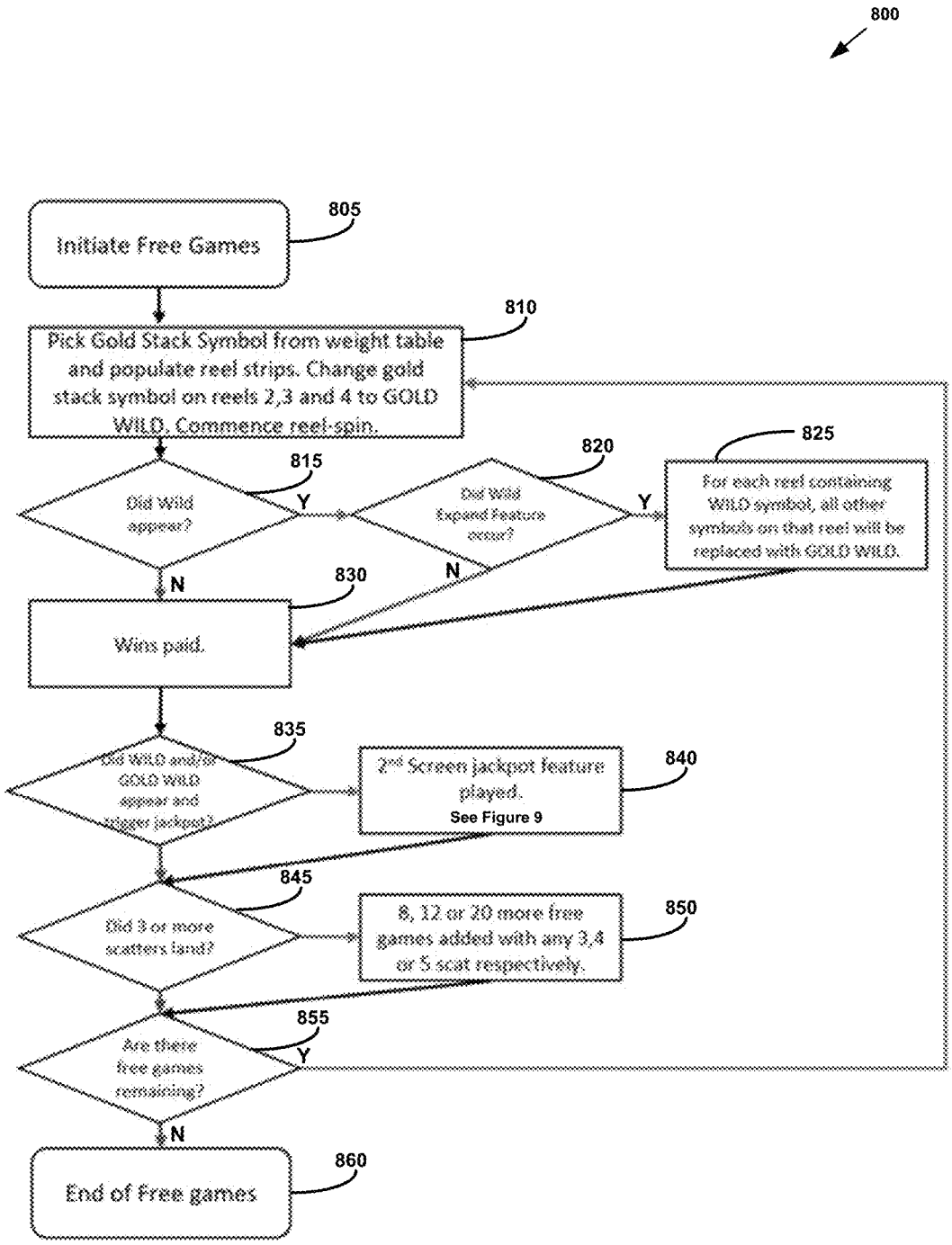
FIG. 8 is a flow chart illustrating an exemplary free games feature, in accordance with at least one embodiment.
Figure 9:
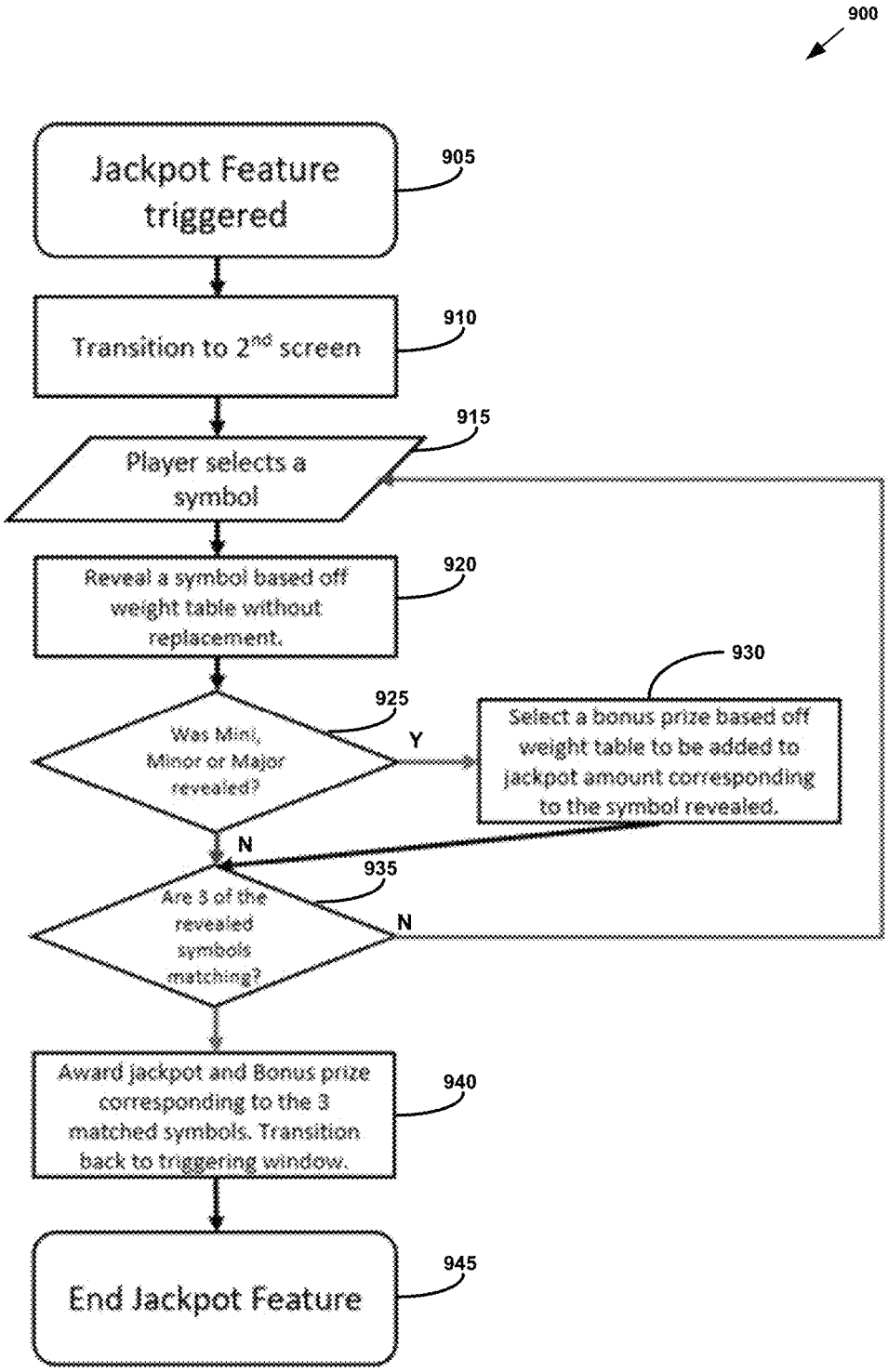
FIG. 9 is a flow chart illustrating an exemplary Jackpot feature, in accordance with at least one embodiment.

The method also involves determining, at step 725, whether the wild or gold wild symbols are sufficient to trigger the jackpot and if they are, the second screen jackpot feature is conducted at step 730 as shown in more detail in FIG. 9. The game controller 60 also determines whether three or more scatters land at step 735 and at step 740, eight, twelve, or twenty free games are awarded based on three, four or five scatter symbols occurring and a series of free games conducted as shown in FIG. 8. The game ends at step 750 and waits for the player to make a further wager and initiate a further game.

Referring to FIG. 8, there is shown a free game method of an embodiment. At step 805, the game controller initiates a series of free games. As in the base game, the game controller selects gold stack symbols using a weighted table and populates the reel strips. The game controller also changes gold stack symbols on reels two, three, and four to gold wild symbols and commences a spin of the reels. Steps 815, 820 and 825 are like steps 715, 717 and 719 in that the game controller determines whether a wild symbol appears and determines whether to expand the wilds 820. Where the expansion condition is met, all other symbols on that reel and any other reel having wild symbols will be replaced with gold wild symbols at step 825. Wins are paid at step 830 and at step 835, it is determined whether the wild and/or gold wild symbols, trigger the jackpot feature at step 835 in which case the second screen jackpot feature is played at step 840 as shown in FIG. 9. At step 845 it is determined whether three or more scatters land and if they have, eight, twelve or twenty more free games are added to a counter of free games with any three, four or five scatter symbols at step 850. At step 855, it is determined whether there are any free games remaining and if there are, the method loops back to step 810. Otherwise, the free games end at step 860.

Referring to FIG. 9 there is shown a flow chart of the jackpot feature. When the jackpot feature is triggered at step 905, the gaming machine transitions to a second screen 910. A player selects a symbol (selectable icon) at step 915 and, at step 920, the game controller reveals a symbol to the player based on a weighted table without replacement. At step 925, the game controller determines whether a mini, minor or major symbols were revealed and if one of them was, at step 930, selects a bonus prize from a weighted table to be added to a bonus meter corresponding to the symbol revealed. Note that no bonus prize is added where the grand jackpot symbol is revealed in this embodiment. In other embodiments, bonus meters may be associated with all the jackpot prizes that are available. At step 935, it is determined whether any of the three revealed symbols are matching. That is, it is determined whether a win condition is satisfied in respect of any of the jackpot prizes. At step 940, the game controller awards the jackpot corresponding to the three matching symbols as well as any bonus prize stored in the meter associated with that jackpot before returning to the triggering window. In this respect, the game controller returns back either to the base game shown in FIG. 7 or to the free games shown in FIG. 8.

If at step 935 the symbols are not matching, the game loops back to step 915 and the player selects a further icon. Once a jackpot prize has been awarded in step 940, the jackpot feature ends.

Figure 12A:
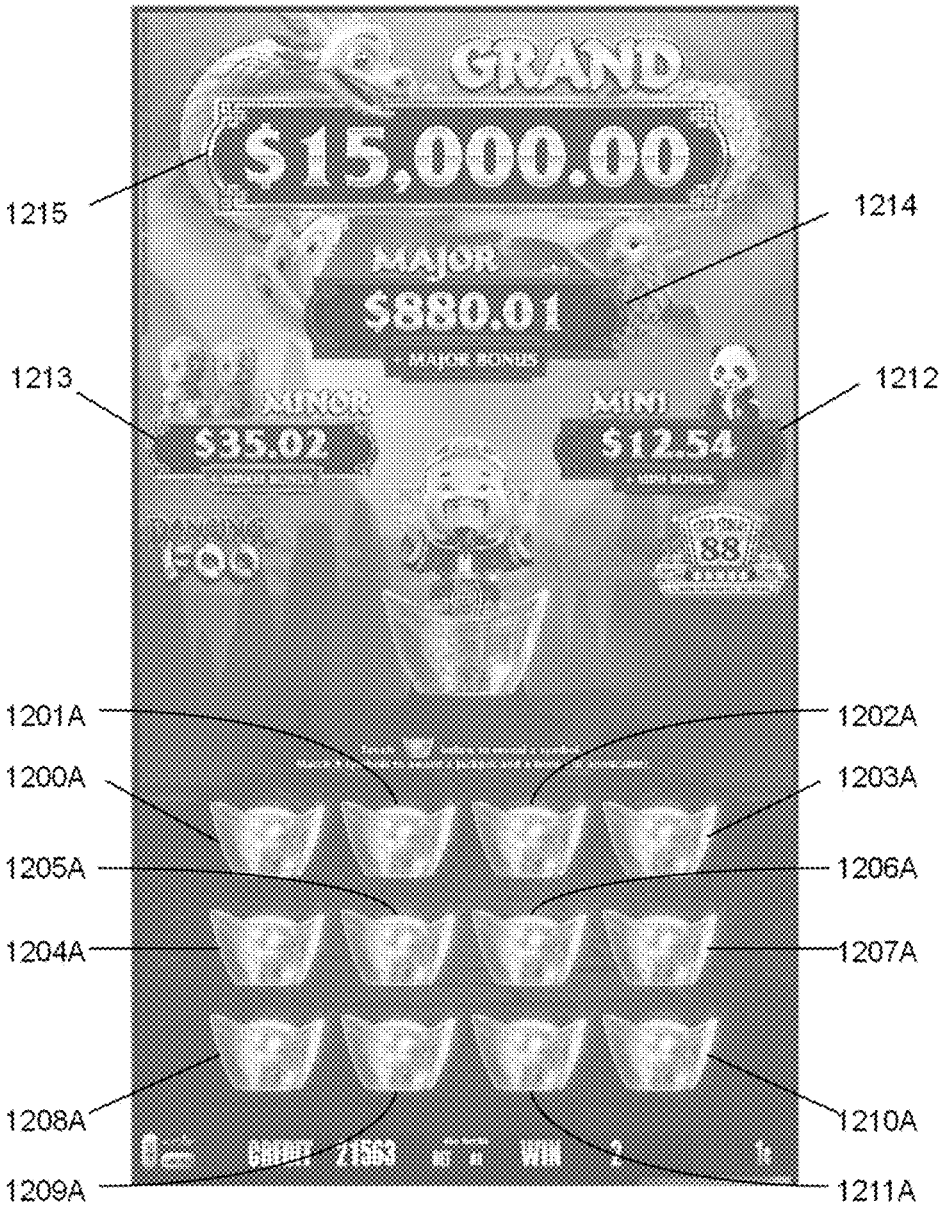
FIGS. 12A to 12K show an example plurality of screenshots of a sequence of updates resulting from a player playing a jackpot feature, in accordance with at least one embodiment.

FIGS. 12A to 12K show an example sequence of updates to the second screen as a result of receiving player selections (step 915). FIG. 12A shows the second screen as a result of the transition at step 910. As can be seen, there is an arrangement of selectable icons 1200A-1211A. Each selectable icon 1200A-1211A is shown in a hidden state (i.e. there are no symbols revealed). Also shown is mini bonus meter 1212, minor bonus meter 1213, major bonus meter 1214, and jackpot meter 1215.

Figure 12B:
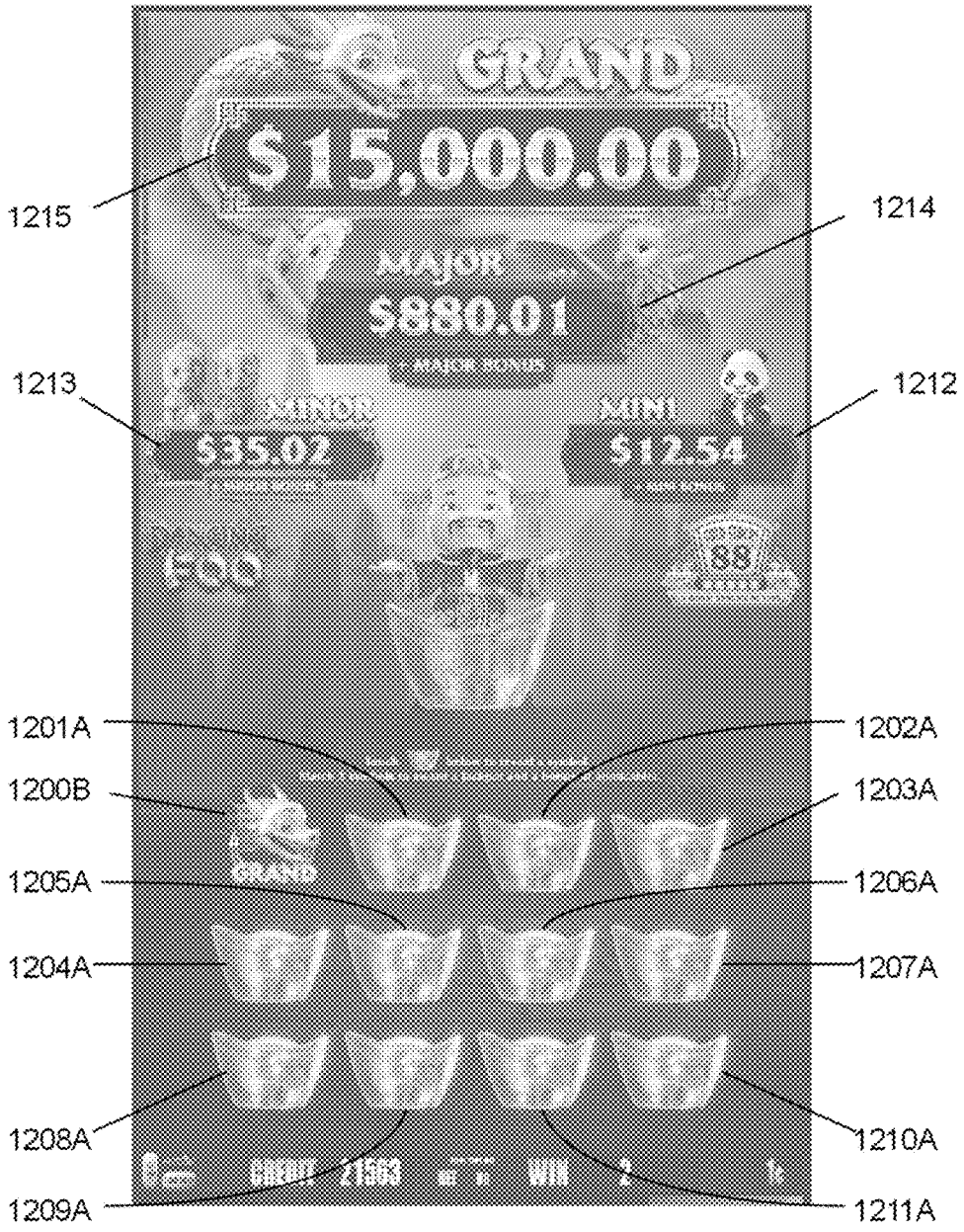

FIG. 12B shows a result of steps 915 and 916. Here, player has selected selectable icon 1200A, resulting in a symbol 1200B being revealed in its place. In the present example, symbol 1200B is a grand jackpot symbol. Therefore, step 925 does not result in an update to a bonus meter (e.g. no update to jackpot meter 1215). Additionally, as there are not three identical symbols revealed, step 935 results in a return to a state awaiting further selection by the player.

Figure 12C:
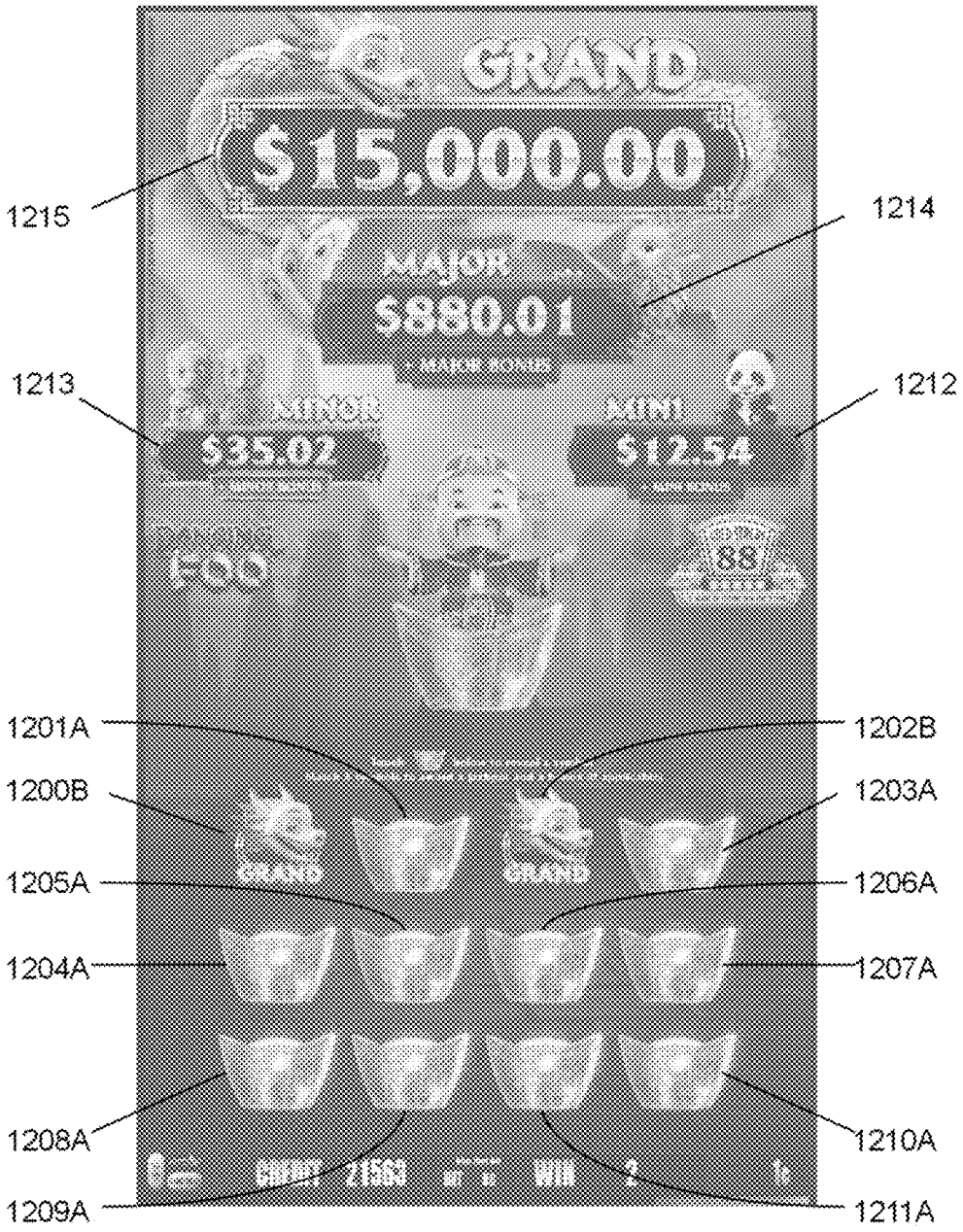
Figure 12D:
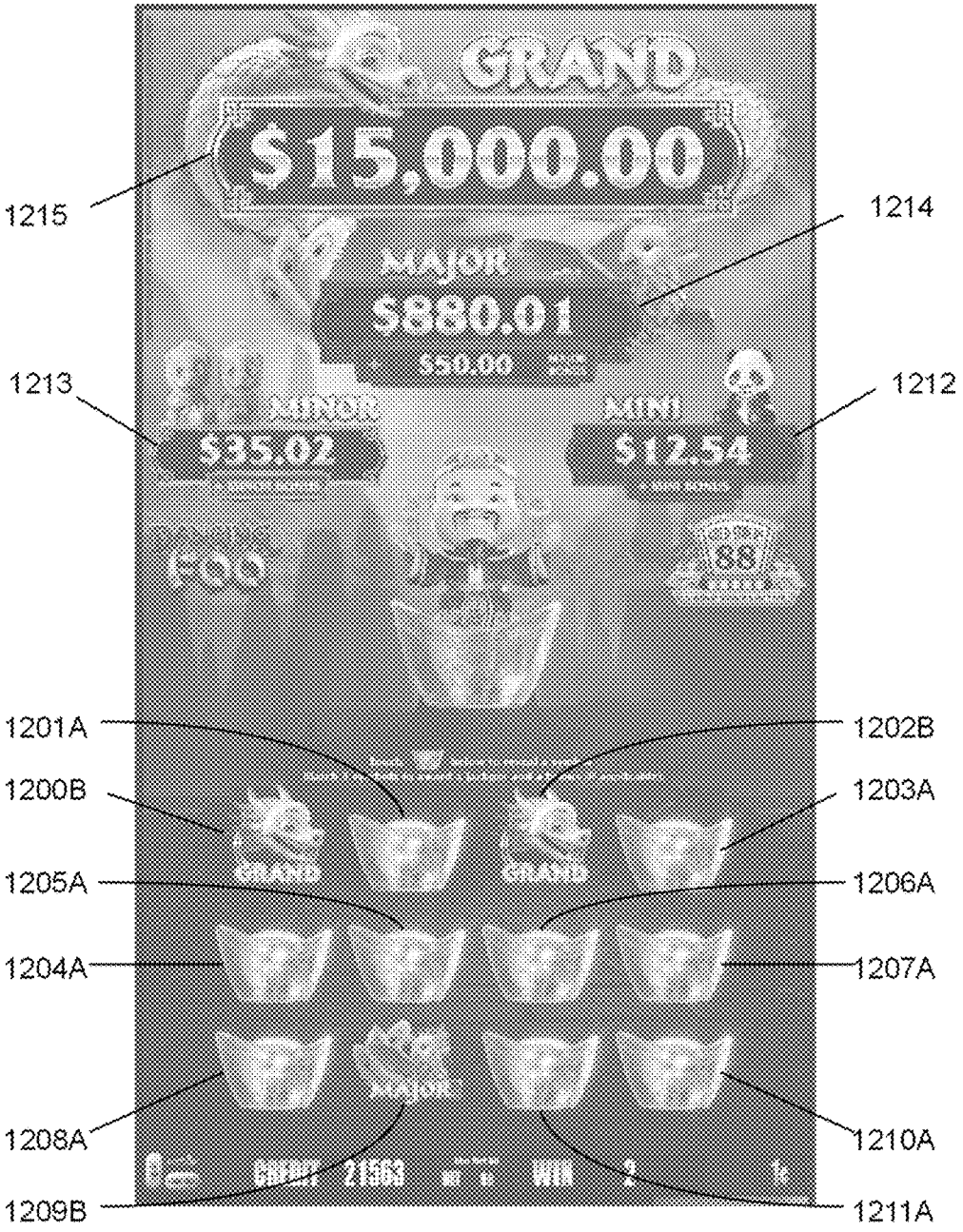

FIG. 12C shows a result of repeating steps 915 and 916. Here, player has selected selectable icon 1202A, resulting in a symbol 1202B being revealed in its place. In the present example, symbol 1202B is a grand jackpot symbol. Therefore, again step 925 does not result in an update to a bonus meter. Additionally, again as there are not three identical symbols revealed, step 935 results in a return to a state awaiting further selection by the player.

FIG. 12D shows a result of again repeating steps 915 and 916. Here, player has selected selectable icon 1209A, resulting in a symbol 1209B being revealed in its place. In the present example, symbol 1209B is a major bonus symbol. Therefore, step 925 results in an update to the major bonus meter 1214 (see the "+$50.00 MAJOR BONUS"). Still, as there are not three identical symbols revealed, step 935 results in a return to a state awaiting further selection by the player.

Figure 12E:
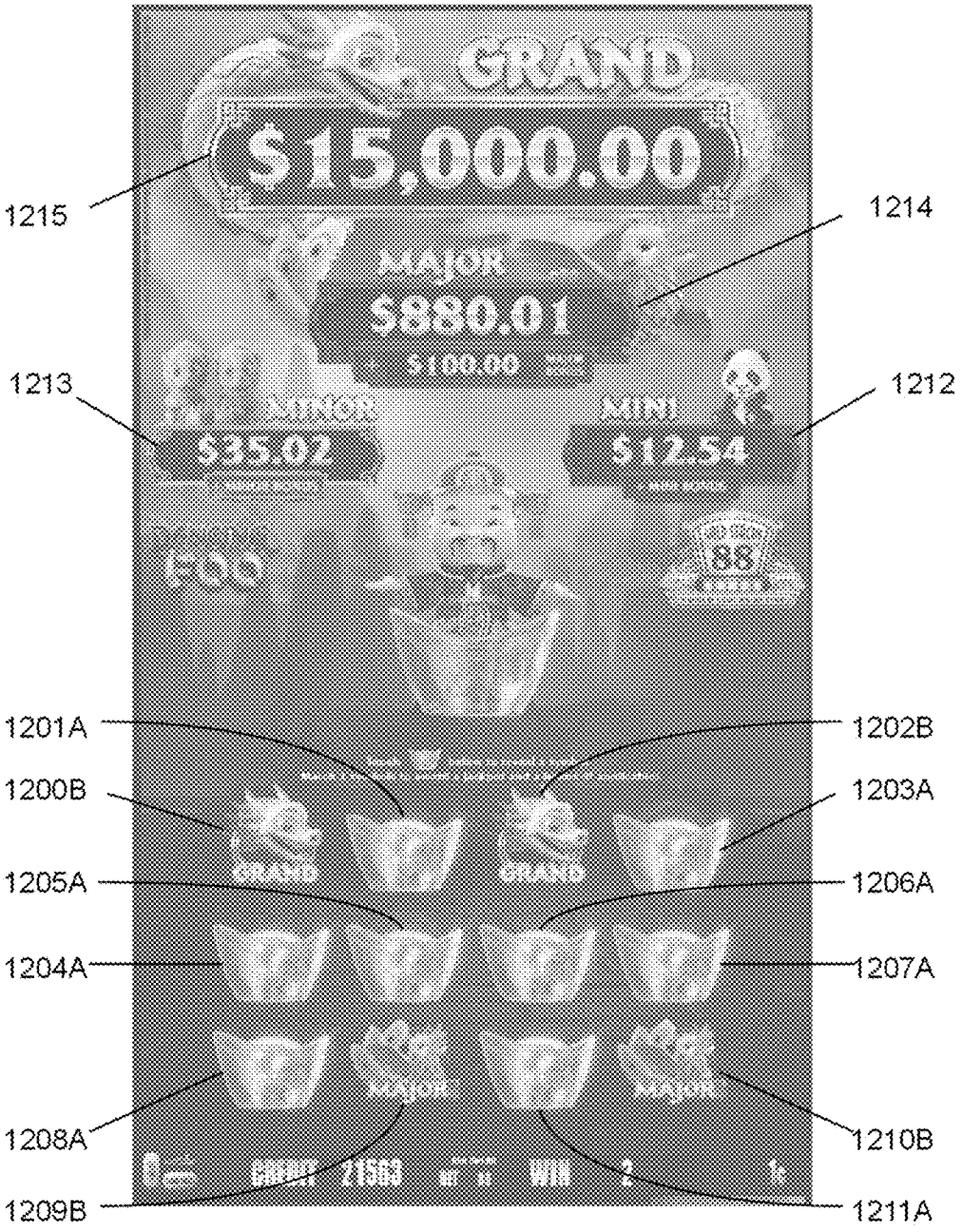
Figure 12F:
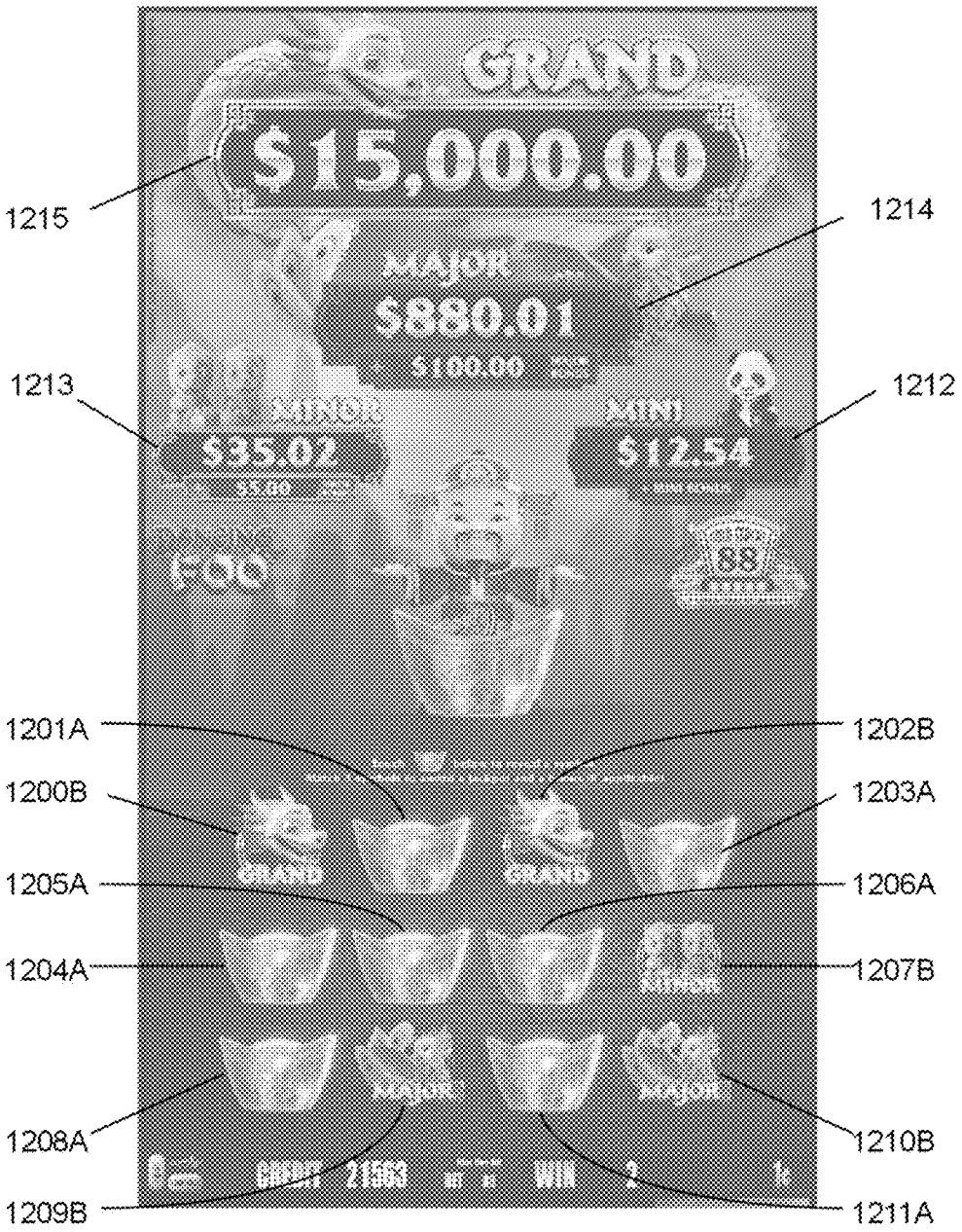
Figure 12G:
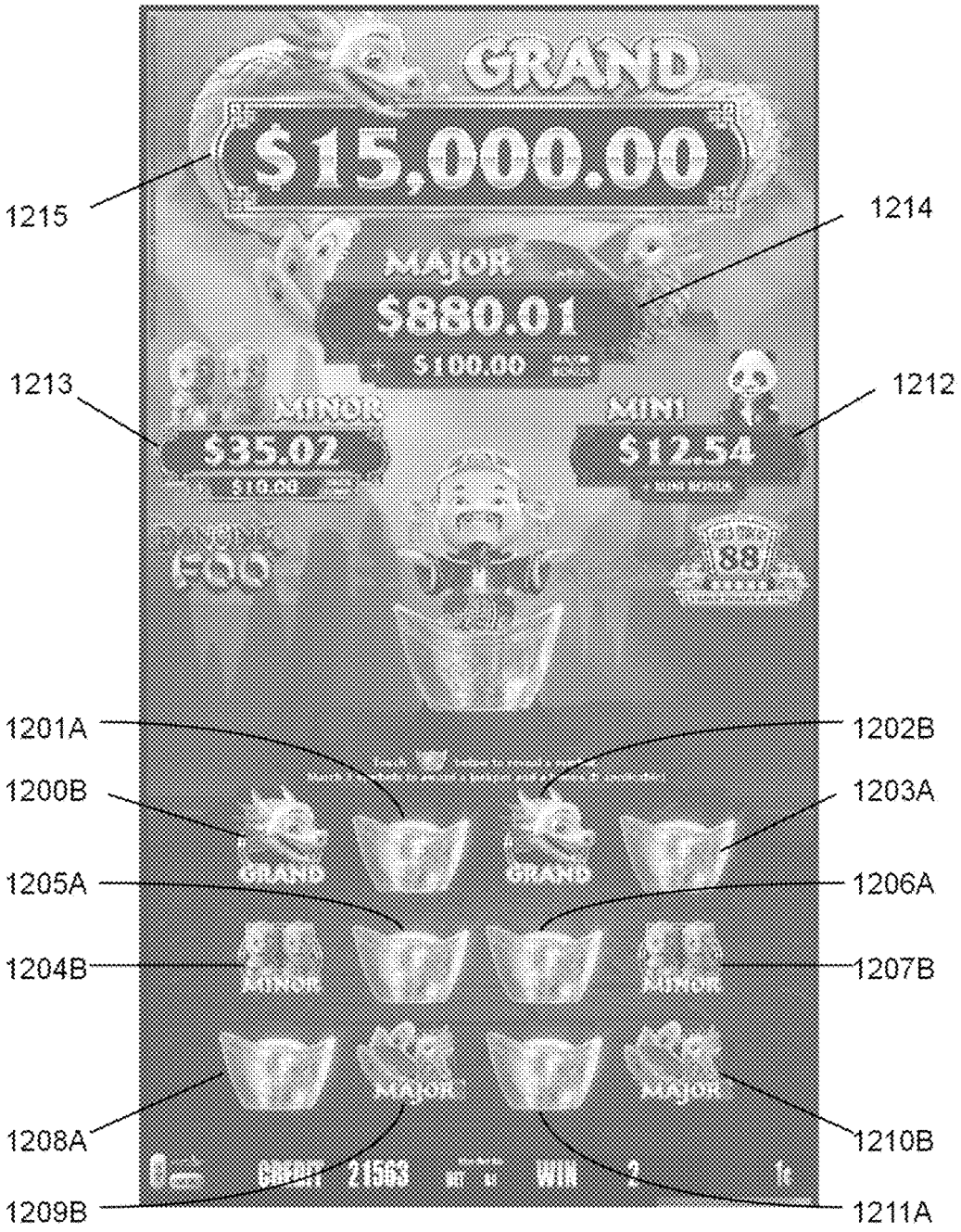
Figure 12H:
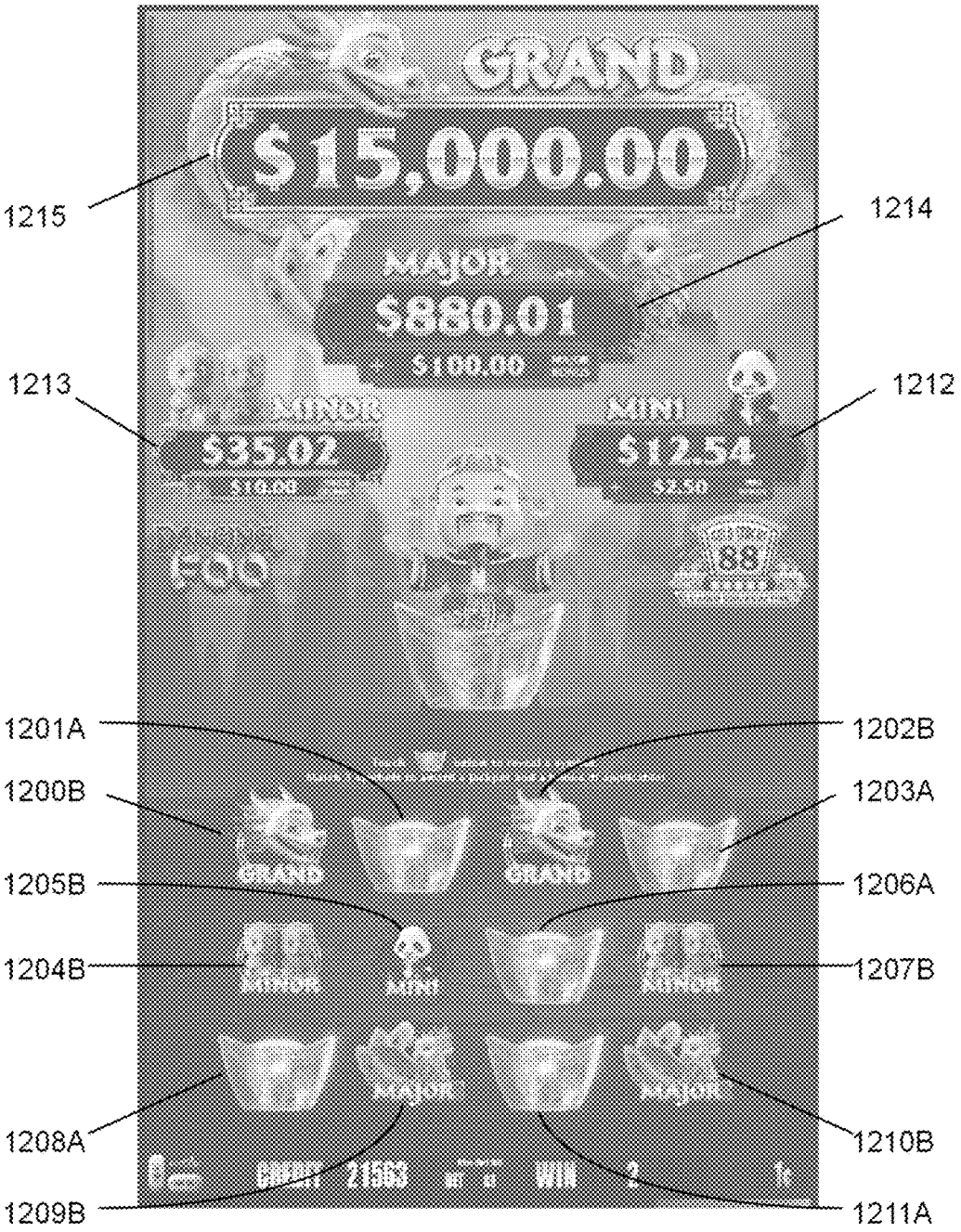
Figure 12I:
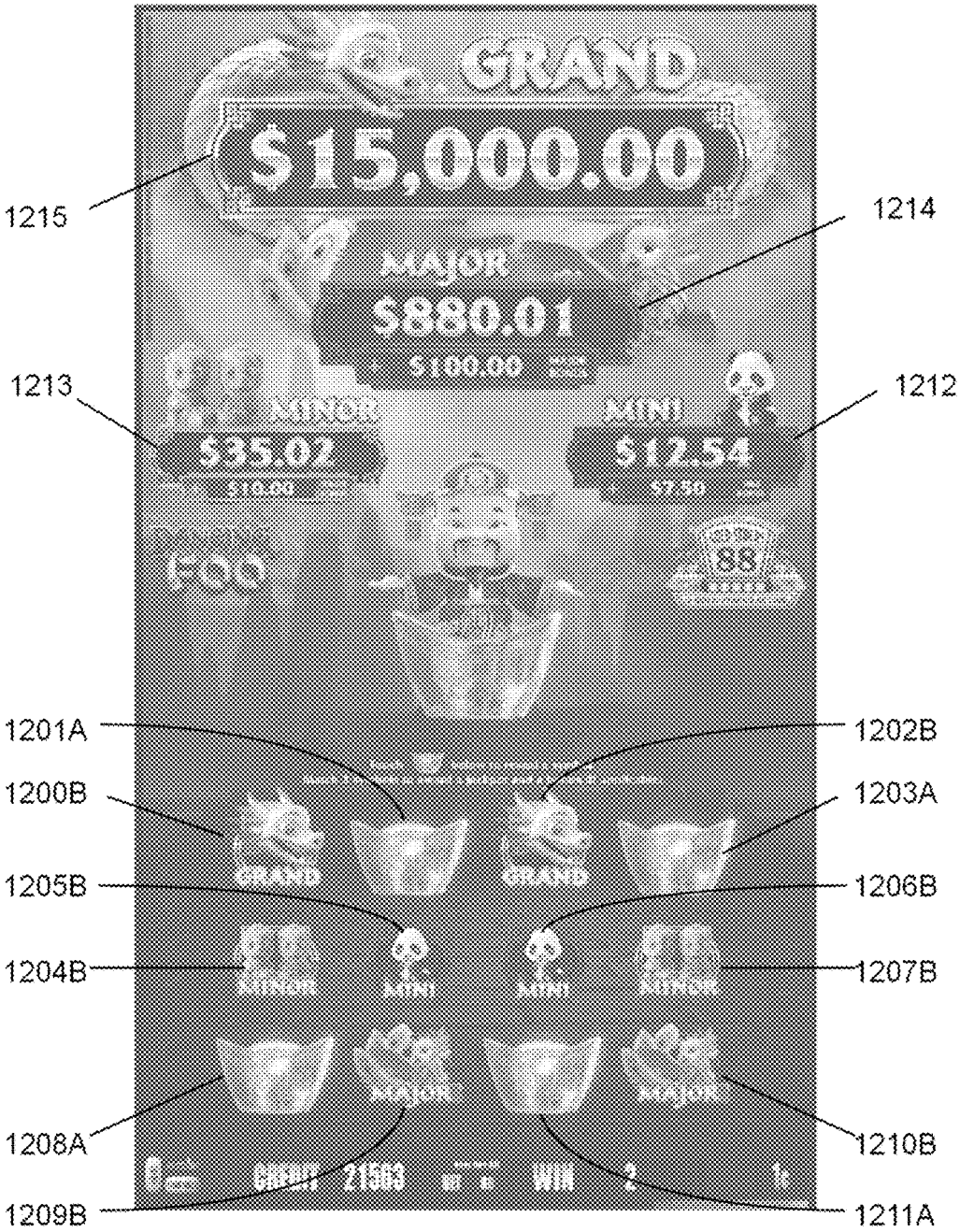

The player then makes further selections in the following order. FIG. 12E shows selection of selectable icon 1211A, revealing symbol 1211B as being a major bonus symbol therefore resulting in an update to the major bonus meter 1214. FIG. 12F shows selection of selectable icon 1207A, revealing symbol 1207B as being a minor bonus symbol therefore resulting in an update to the minor bonus meter 1213 (see "+$5 MINOR BONUS"). FIG. 12G shows selection of selectable icon 1204A, revealing symbol 1204B as being a minor bonus symbol therefore resulting in an update to the minor bonus meter 1213. FIG. 12H shows selection of selectable icon 1205A, revealing symbol 1205B as being a mini bonus symbol therefore resulting in an update to the mini bonus meter 1212 (see "+$2.50 MINI BONUS"). FIG. 12I shows selection of selectable icon 1206A, revealing symbol 1206B as being a mini bonus symbol therefore resulting in an update to the mini bonus meter 1212.

Figure 12J:
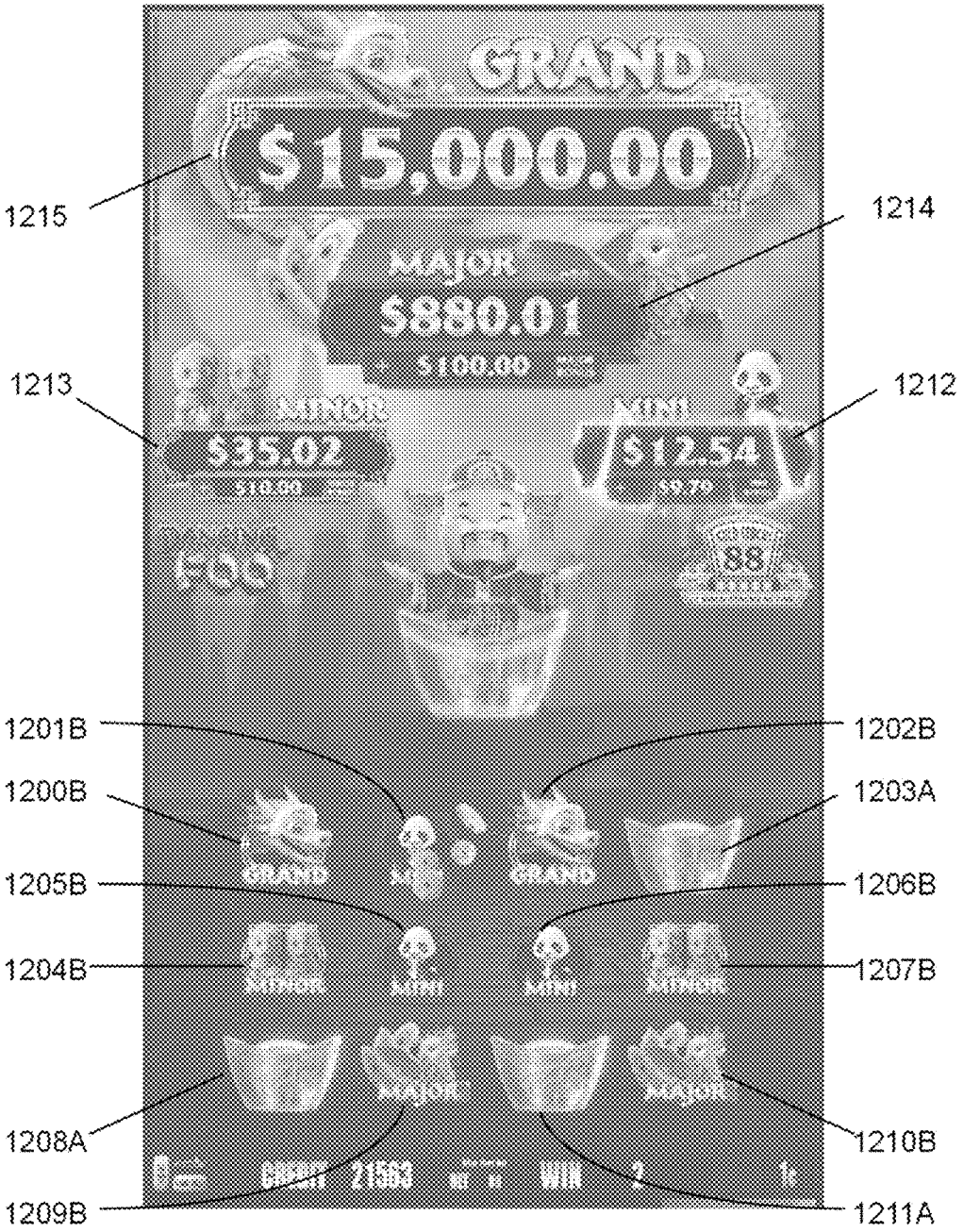
Figure 12K:
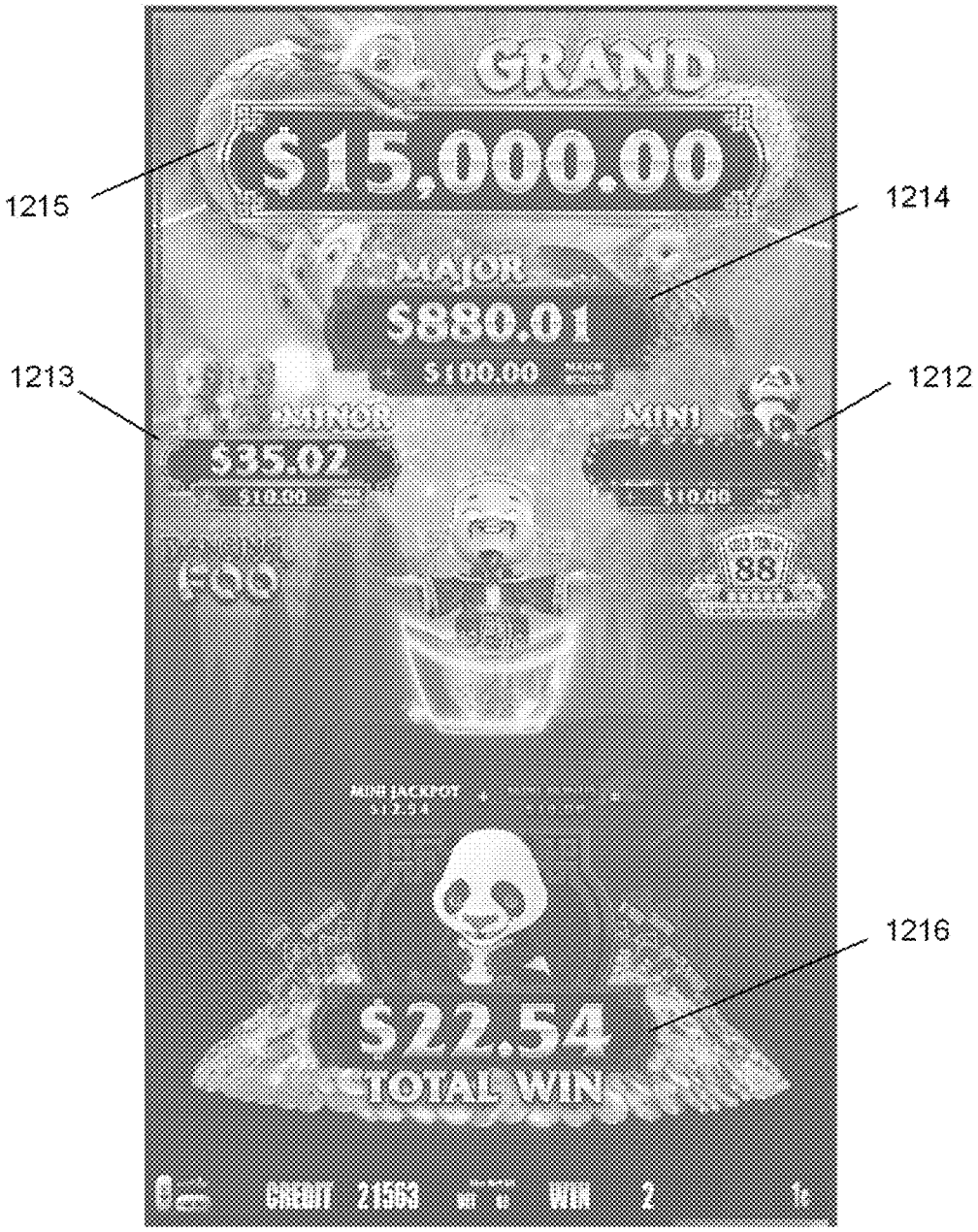

Player selection of selectable icon 1201A in FIG. 12J reveals symbol 1201B as being a mini bonus symbol, resulting in an update to the mini bonus meter 1212. Furthermore, at step 935 it is determined that three identical symbols are present: specifically, symbol 1201B, symbol 1205B, and symbol 1206B each correspond to a mini bonus symbol. Therefore, the method of FIG. 9 proceeds to step 940. In FIG. 12K, a total win 1216 equal to the updated mini prize is shown awarded according to step 940.

Figure 10:
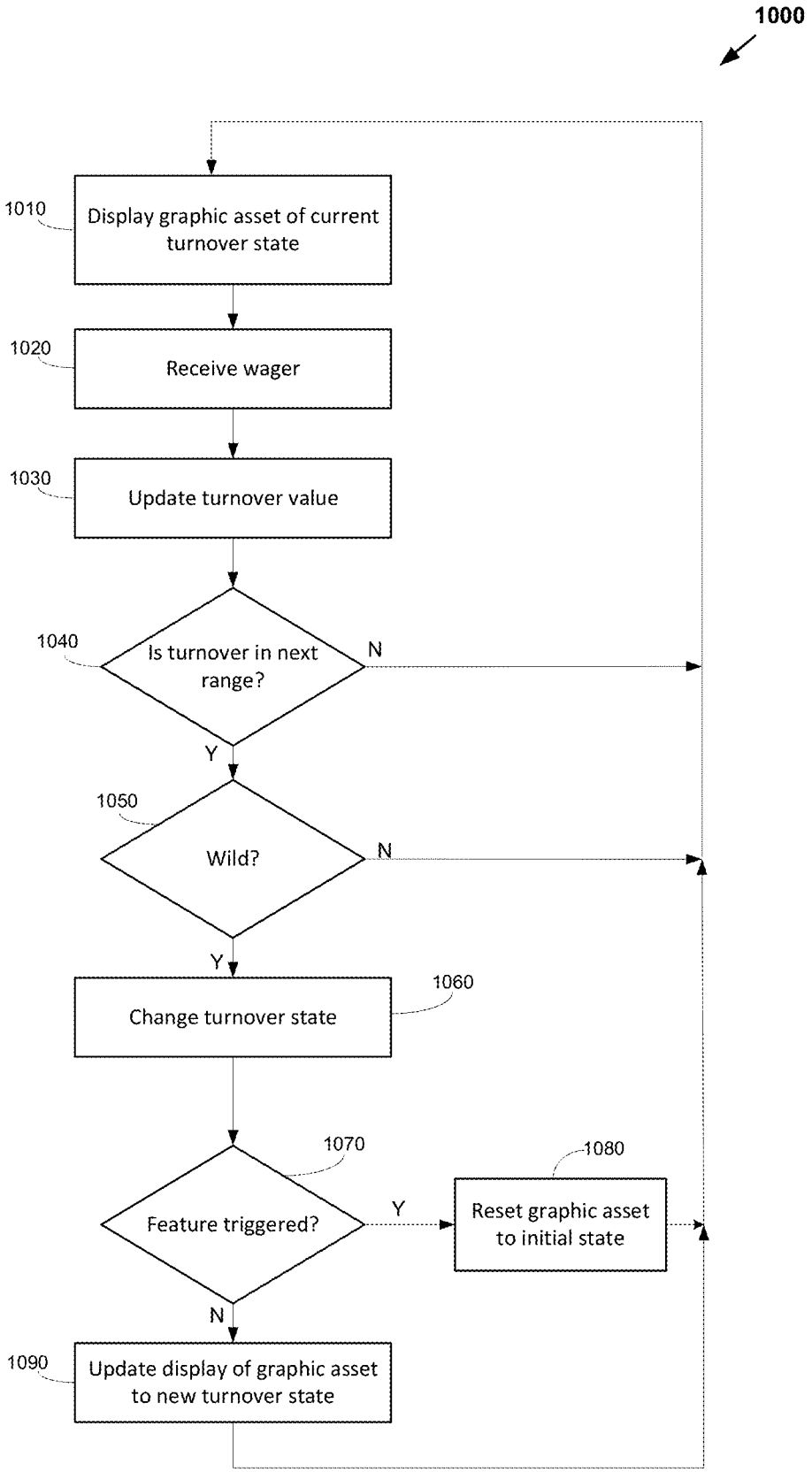
FIG. 10 is a flow chart illustrating an exemplary process for updating graphic assets, in accordance with at least one embodiment.
Figure 13A:
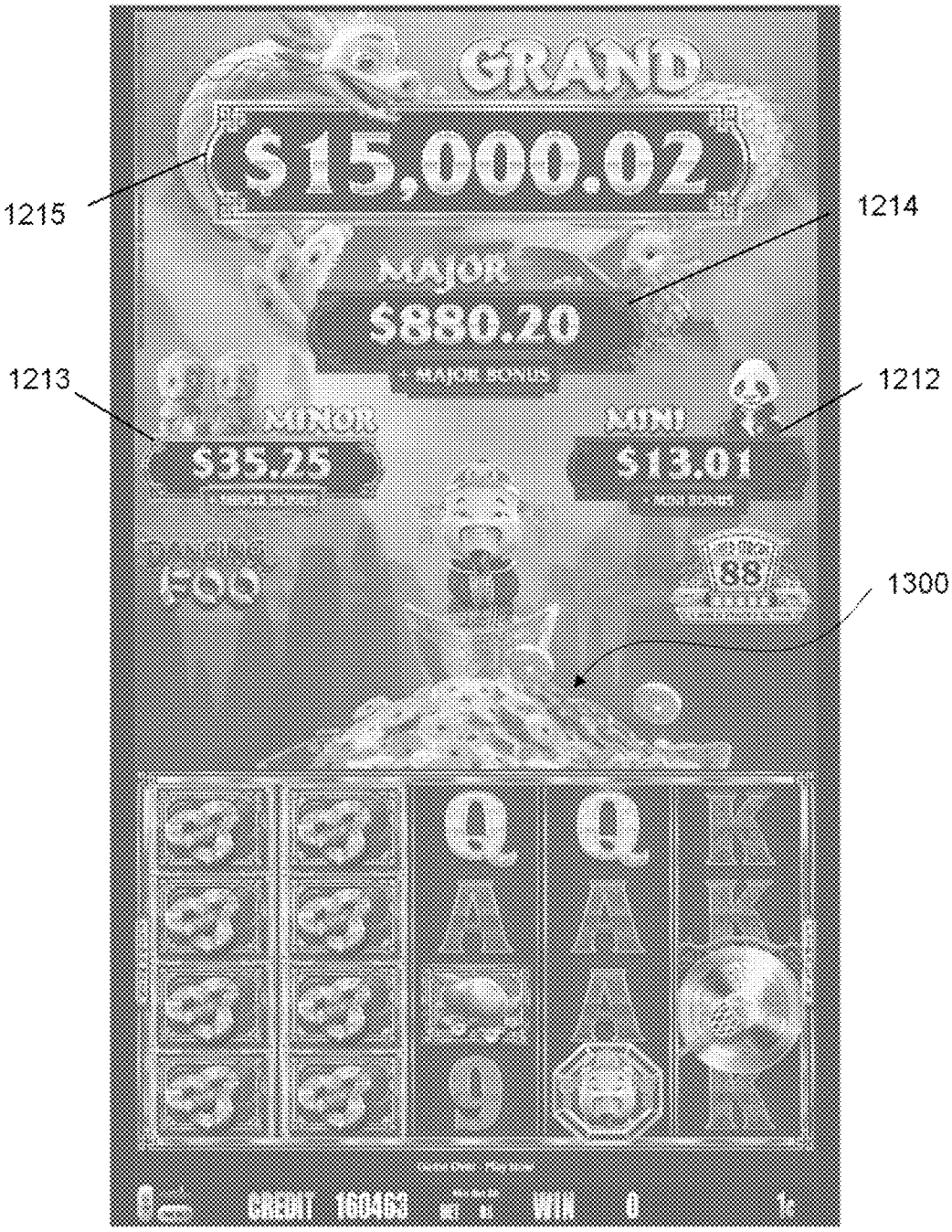
FIGS. 13A to 13C show an example plurality of screenshots of updating of a graphic asset, in accordance with at least one embodiment.
Figure 13B:
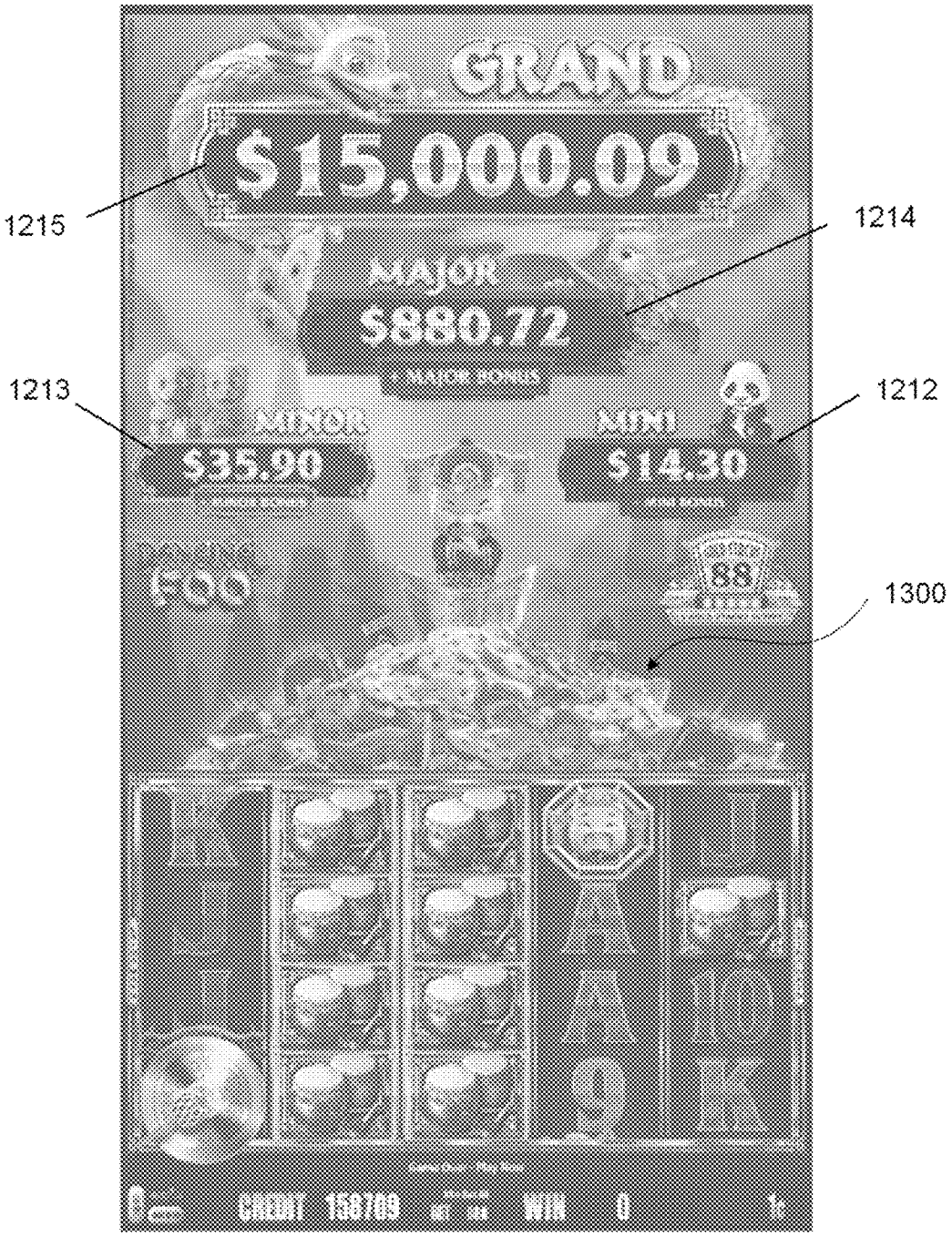
Figure 13C:
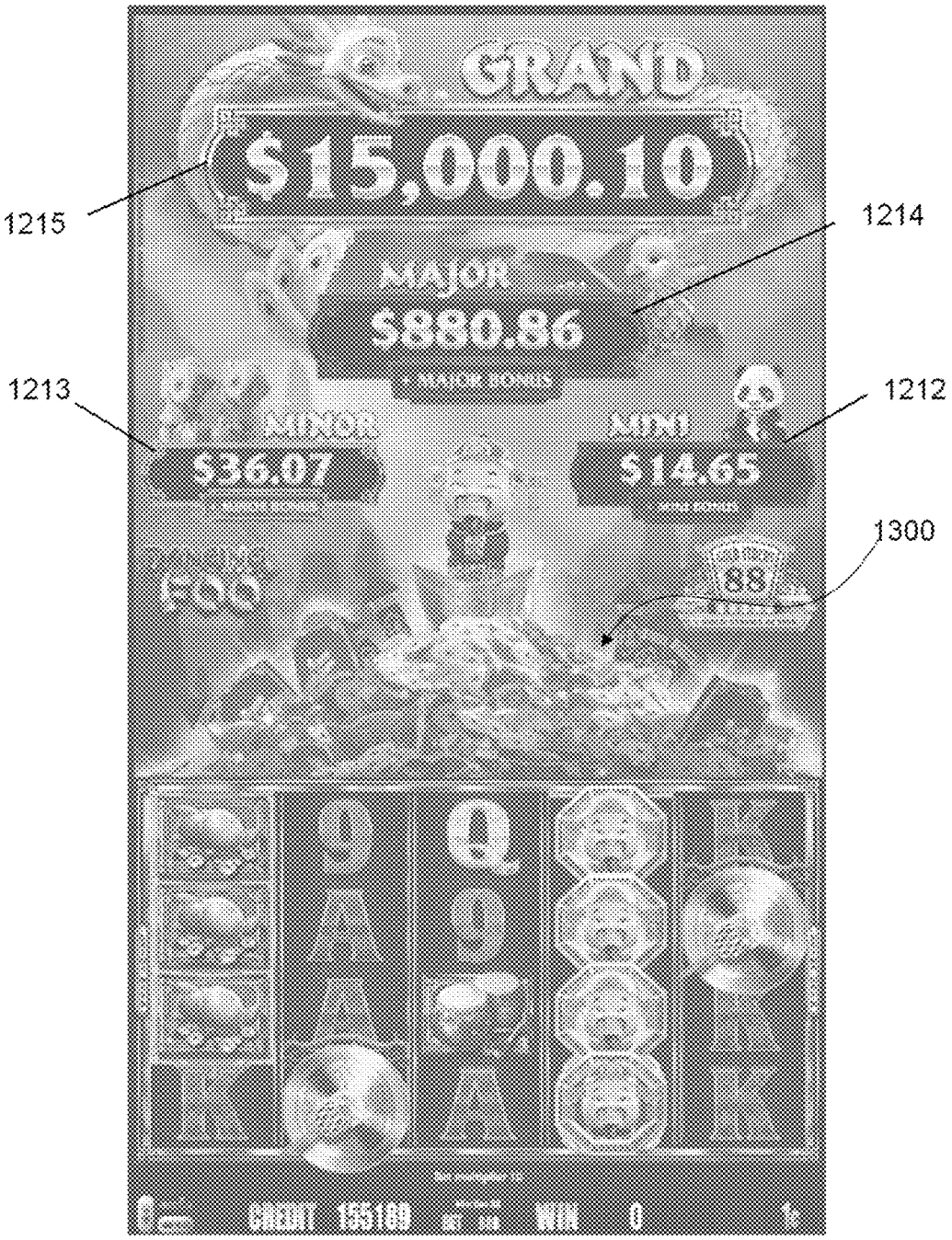

Referring now to FIG. 10, there is shown a flow chart 1000 of updating graphic assets. At step 1010, the game controller controls the display to display the graphic asset corresponding to the current turnover state (for example, FIG. 13A shows graphic asset 1300, representing a pile of gold coins, where the size of the pile corresponds to the current turnover state). At step 1020, the game controller processes the received wager. At step 1030, the game controller updates the turnover value. At step 1040, it is determined whether the turnover is in the next range. In this respect, the turnover may already be in the next range or may be incremented into the next range in the current game. At step 1050, the game controller determines whether a designated symbol, here a wild symbol, has been selected for display and, if not, the game controller will continue to display the graphic asset of the current turnover state. If the turnover is in the next range and the wild symbol is displayed then at step 1060 the game controller changes the turnover state. However, before updating display of the graphic asset to the new turnover state, the game controller determines whether the feature game is triggered at step 1070 and only updates the display of the graphic asset at step 1090 if the feature is not triggered. If the feature game is triggered, at step 1080, the game controller resets the graphic asset to the initial state, such that the initial state will be displayed at step 1010. Referring to FIG. 13B, where a wild symbol in row 1 column 4 is displayed but the feature game is not triggered, the graphic asset 1300 is updated to represent the new turnover state—in the example, the representation of the pile of gold coins is changed to provide an impression of a larger pile of gold coins when compared to FIG. 13A. FIG. 13C, where wild symbols in the entire column 4 is displayed but the feature game is not triggered, shows the graphic asset 1300 yet again updated to represent a larger pile of gold coins to that shown in FIG. 13B.

Figure 11:
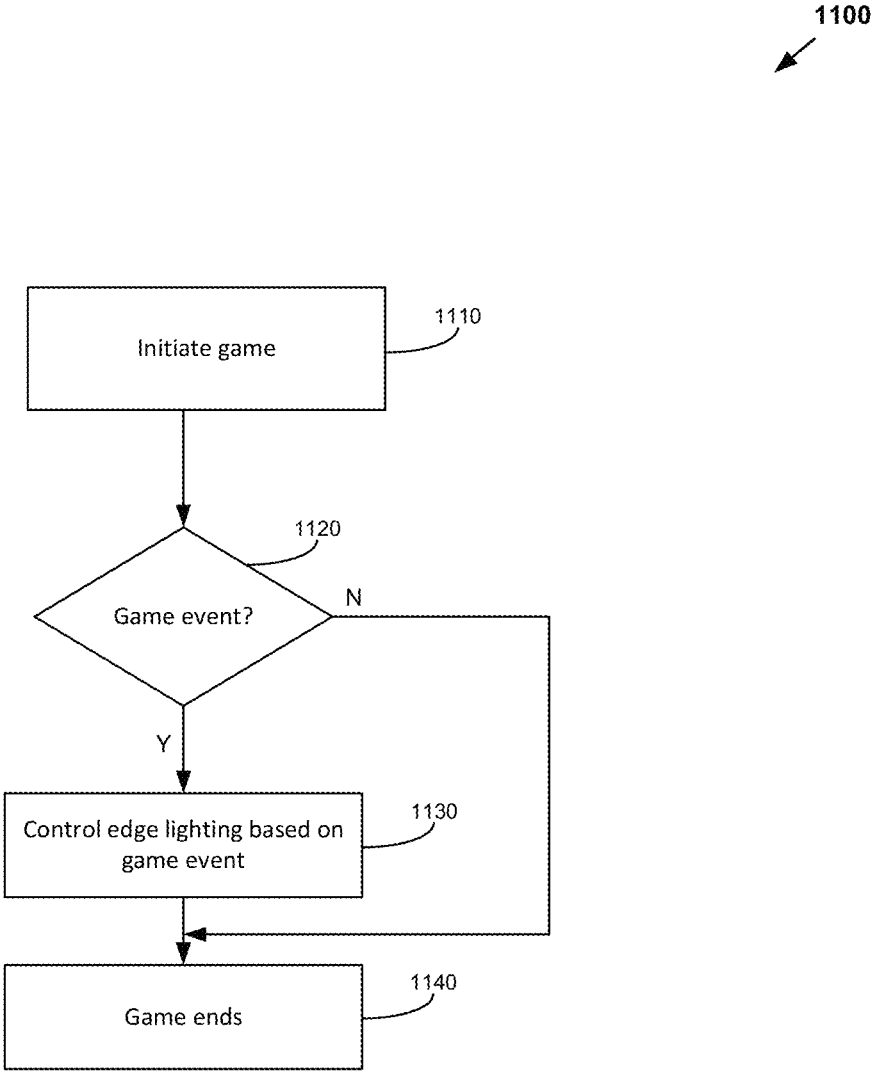
FIG. 11 is a flow chart illustrating a process for controlling edge lighting, in accordance with at least one embodiment.

FIG. 11 shows a method 1100 of control edge lighting. At step 1110, a game is initiated and at step 1120, it is determined whether a game event occurs corresponding to a lighting configuration within the game and if it does, the game controller controls the edge lighting based on the game event at step 1130 before the game ends at step 1140.

FIGS. 14A to 14D show examples of different edge lighting effects depending on a particular game event, according to an embodiment. In the figures, a circle represents a specific light source—a white fill indicates an illuminated light and a black fill indicates a non-illuminated light. Alternatively, the different fills may represent different colors. The light sources are shown surrounding display 14. In embodiments, each light source is illuminated by one or more light emitting diodes. One or more adjacent light sources may be synchronously illuminated to dynamically form an illuminated section.

Figure 14A:
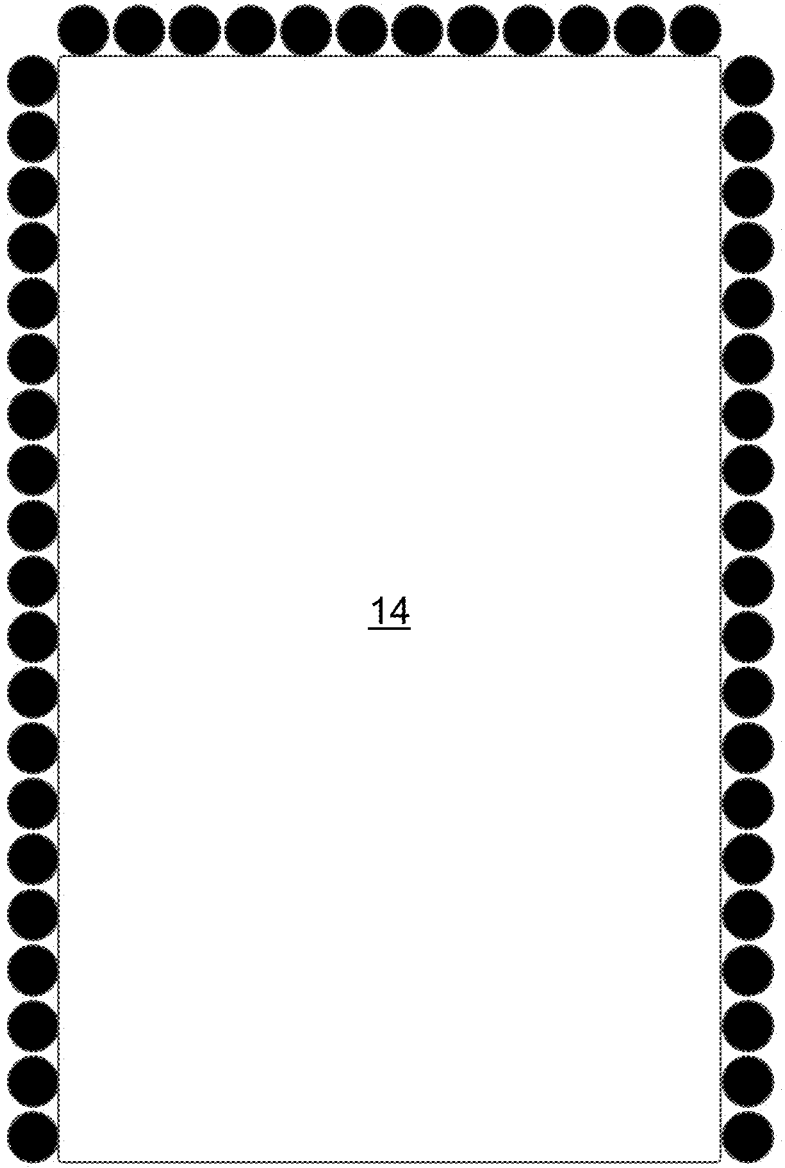
FIGS. 14A to 14D are schematic diagrams illustrating examples of different edge lighting effects, in accordance with at least one embodiment.
Figure 14B:
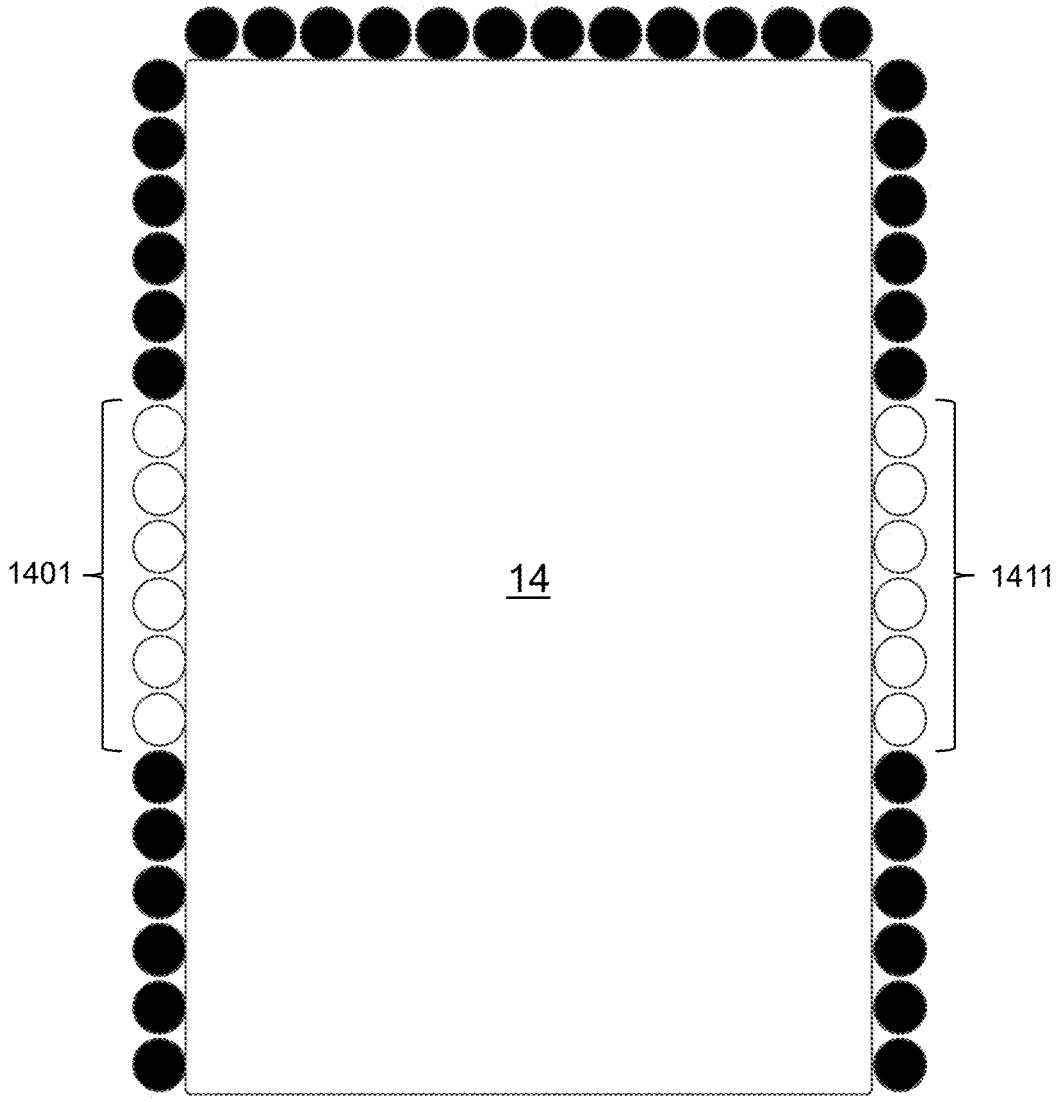
Figure 14C:
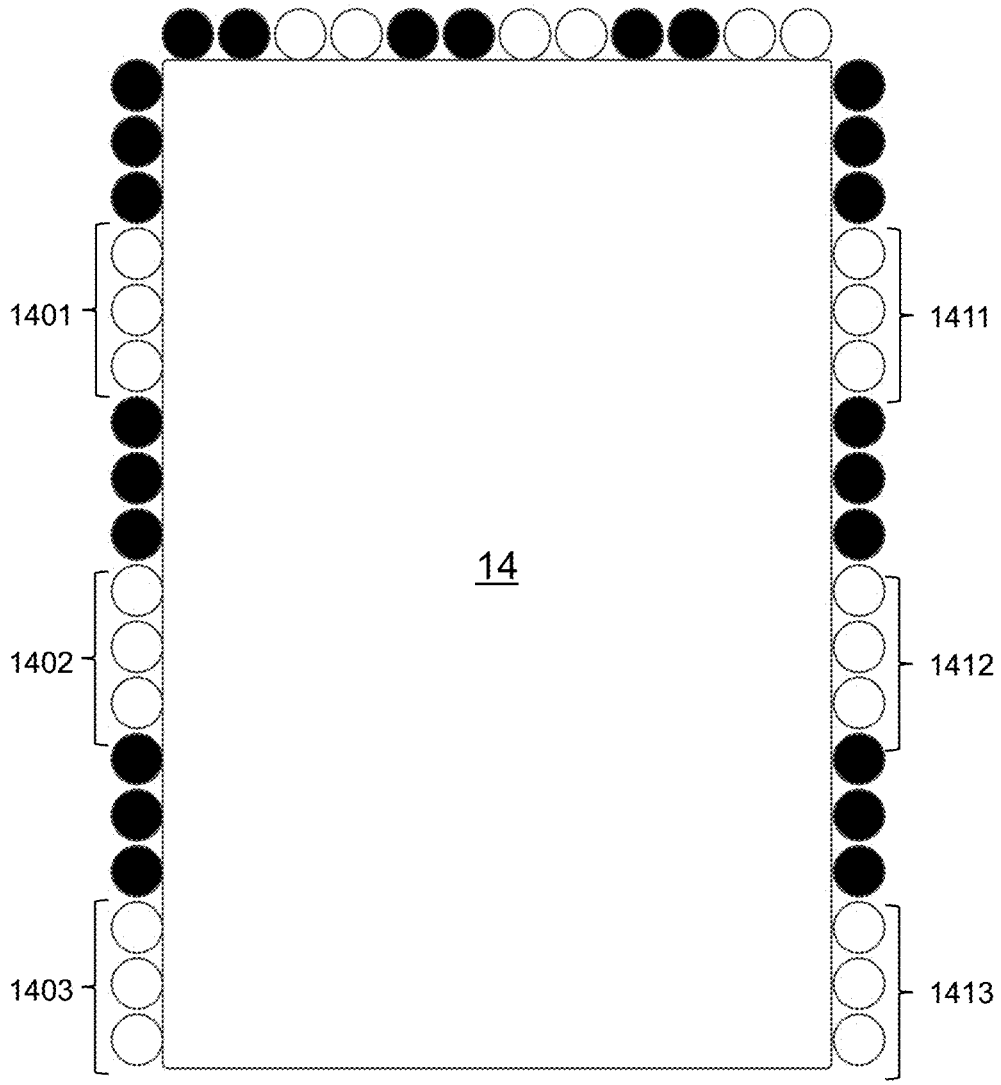
Figure 14D:
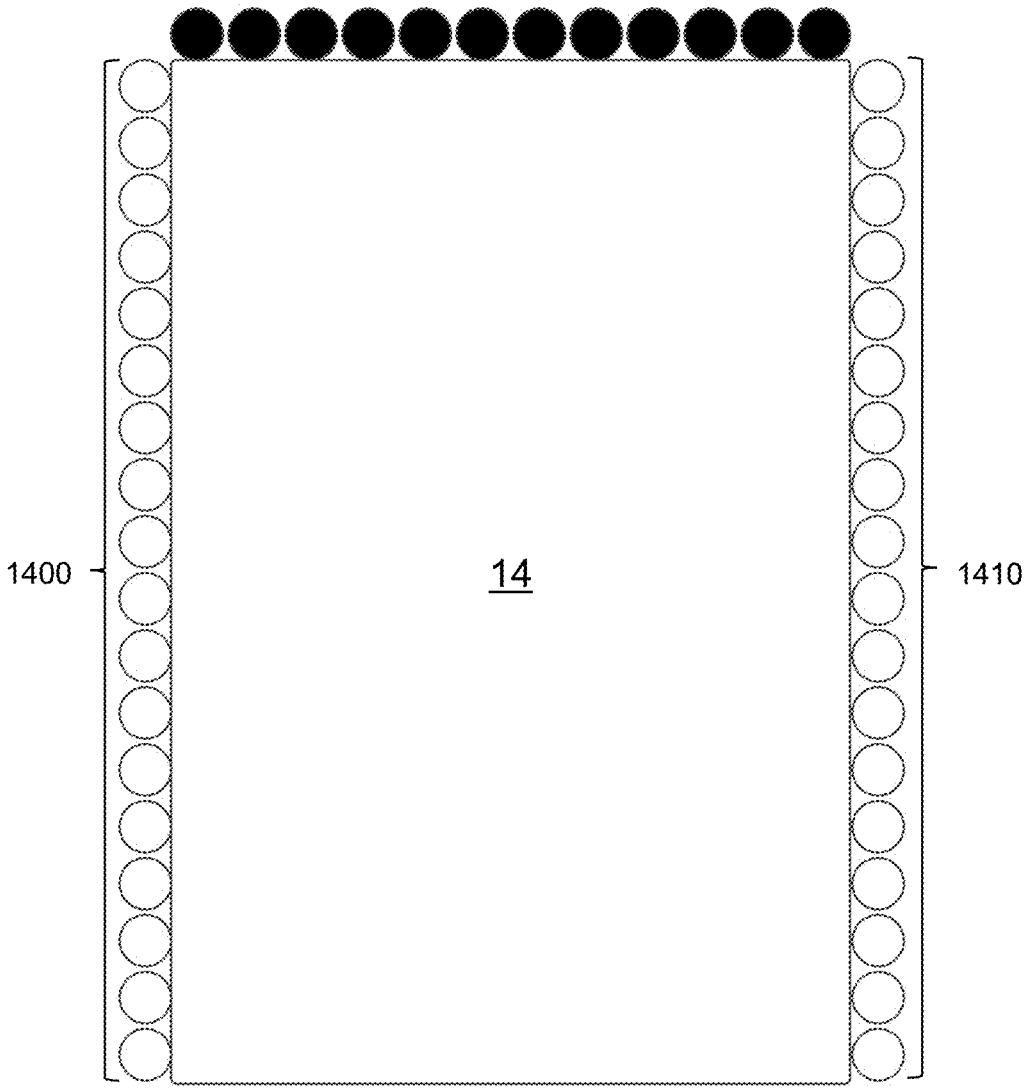

In FIG. 14A, the game event corresponds to no wild symbols being present as a result of gameplay (e.g. as described with reference to FIG. 7). The corresponding edge lighting effect comprises no specific illumination. In FIG. 14B, the game event corresponds to one wild symbol being present as a result of gameplay (e.g. as exemplified in FIG. 13B with a wild symbol in row 1 column 4). The corresponding edge lighting effect comprises illuminating one section 1401 on the left side and one section 1411 on the right side. In FIG. 14C, the game event corresponds to three wild symbols being present as a result of gameplay (e.g. as exemplified in FIG. 15A with wild symbols in row 4 column 2, row 1 column 3 and row 3 column 4). The corresponding edge lighting effect comprises illuminating three sections 1401, 1402, 1403 on the left side and three sections 1411, 1412, 1413 on the right side. In the example shown, the top edge is also illuminated in sections. In FIG. 14D, the game event corresponds to a wild expand feature occurring (e.g. exemplified in FIGS. 13B and 13C, and separately in FIGS. 15A and 15B). The corresponding edge lighting effect comprises illuminating the entire left side 1400 and the entire right side 1410.

In a general sense, any number of specific game events can each be associated with a specific lighting configuration. It may be that each specific lighting configuration is uniquely associated with one of the game events, although, in an embodiment at least one specific lighting configuration is associated with two or more game events. A specific lighting configuration may comprise a sequence of changes in the illumination of the light sources—for example, to give the impression of a section (e.g. 1401, 1402, 1403, 1411, 1412, 1413) moving along its associated edge. Furthermore, the light sources may be configurable as different colors and each specific lighting configuration includes specification of the color(s) of the light sources.

The specific lighting effects provide an additional indication to the player and other players in the vicinity of the gaming machine as to which particular game event has occurred (or most recently occurred).

Typically, a winning outcome will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method of operating a gaming machine will be apparent from the above description of the gaming machine. It will be appreciated that at least part of the method will be implemented electronically, for example, digitally by a processor executing program code such as in the above description of a game controller. In this respect, in the above description certain steps are described as being carried out by a processor, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible, non-transitory. computer readable storage medium, such as a disc or a memory device, e.g. an EEPROM, (for example, that could replace part of memory 103). Further different parts of the program code can be executed by different devices, for example in a client server relationship. Persons skilled in the art will appreciate that program code provides a series of instructions executable by the processor.

It will be understood to persons skilled in the art that many modifications may be made without departing from the spirit and scope of the present disclosure, in particular it will be apparent that certain features of embodiments of the present disclosure can be employed to form further embodiments.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

What is claimed is:

1. An electronic gaming machine comprising:

a display device;

an interface device;

a plurality of independently controllable edge lighting sections coupled to at least one outer edge of the electronic gaming machine;

a memory device storing a required number of trigger conditions; and a game controller comprising a processor configured to execute instructions stored in the memory device, which, when executed, cause the game controller to:

determine, based upon a plurality of results, a number of trigger conditions that are met;

for each of the number of trigger conditions that are met, cause a corresponding section of the plurality of edge lighting sections coupled to the at least one outer edge of the electronic gaming machine to light up;

determine when the number of the trigger conditions that are met reaches a required number of trigger conditions;

in response to determining the number of trigger conditions that are met reaches the required number of trigger conditions, control the display device to display an electronic game;

determine that at least a predefined number of prize symbols corresponding to a prize of a plurality of prizes are displayed on the display device during the electronic game, wherein each prize is associated in the memory device with an edge lighting configuration; and in response to determining that the predefined number of prize symbols are displayed, cause the plurality of edge lighting sections coupled to the at least one outer edge of the electronic gaming machine to display the edge lighting configuration associated with the prize.

2. The electronic gaming machine of claim 1, wherein the instructions, when executed by the game controller, further cause the game controller to:

display the electronic game including display of a plurality of selectable symbols, the plurality of prizes, and a plurality of bonus meters, wherein each bonus meter of the plurality of bonus meters corresponds to and is displayed in association with at least one prize of the plurality of prizes;

receive, from the interface device, a selection of a selectable symbol of the plurality of selectable symbols;

in response to the selection of the selectable symbol, update the display device to display a prize symbol in place of the selectable symbol; and in response to updating the display device to display one of the prize symbols, control a prize amount to be displayed on the bonus meter of a prize corresponding to the displayed prize symbol.

3. The electronic gaming machine of claim 2, wherein the electronic gaming machine further comprises a random number generator (RNG), and wherein the instructions, when executed by the game controller, further cause the game controller to:

reveal, in response to a plurality of selections of the plurality of selectable symbols, a plurality of prize symbols in place of each selected selectable symbol; and add, in response to each revealing, a prize amount to the bonus meter of the prize corresponding to each revealed prize symbol, such that one of the plurality of bonus meters is incremented and accumulates value each time a prize symbol is revealed.

4. The electronic gaming machine of claim 3, wherein the instructions, when executed by the game controller, further cause the game controller to:

control the RNG to generate an RNG output;

randomly select a weighted table from a plurality of weighted tables stored in the memory device;

perform a lookup in a weighted table of prize symbols stored in the memory device; and based upon at least the RNG output and the lookup, determine the one of the prize symbols to display in place of the selectable symbol.

5. The electronic gaming machine of claim 2, wherein the instructions, when executed by the game controller, further cause the game controller to display the plurality of selectable symbols as part of a bonus game that is triggered from a base game, and wherein, in the base game, the instructions, when executed by the game controller, further cause the game controller to:

display a plurality of symbols from a plurality of reels;

evaluate the plurality of symbols displayed from the plurality of reels to determine whether at least one symbol displayed from at least one reel is a wild symbol, and one of:

in response to determining that the at least one symbol from the at least one reel is a wild symbol, and if a trigger condition occurs: replace all of the symbols displayed from the at least one reel with wild symbols, such that the wild symbol displayed from the at least one reel appears to expand to populate the remainder of the at least one reel; or in response to determining that the at least one symbol from the at least one reel is a wild symbol, and if the trigger condition does not occur: update a graphic asset displayed on the display such that a value associated with the graphic asset increases, and such that the graphic asset appears to increase in one of size or value.

6. The electronic gaming machine of claim 5, wherein the instructions, when executed by the game controller, further cause the game controller to control an edge lighting effect of the edge lighting based upon a number of wild symbols displayed during the base game.

7. The electronic gaming machine of claim 2, wherein the interface device comprises a touchscreen and wherein the instructions, when executed by the game controller, further cause the game controller to cause display of the plurality of selectable symbols as part of the electronic game comprising a bonus game that is triggered from a base game.

8. A method of operating an electronic machine including a game controller, a display device, an interface device, and a plurality of edge lighting sections coupled to at least one outer edge of the electronic gaming machine, the game controller comprising a processor configured to execute instructions stored in a memory device storing a required number of trigger events, the method comprising:

determining, based upon a plurality of results, a number of trigger conditions that are met;

for each of the number of trigger conditions that are met, causing a corresponding section of the plurality of edge lighting sections coupled to the at least one outer edge of the electronic gaming machine to light up;

determining when the number of the trigger conditions that are met reaches a required number of trigger conditions;

in response to determining the number of trigger conditions that are met reaches the required number of trigger conditions, controlling the display device to display an electronic game;

determining that at least a predefined number of prize symbols corresponding to a prize of a plurality of prizes are displayed on the display device during the electronic game, wherein each prize is associated in the memory device with an edge lighting configuration; and in response to determining that the predefined number of prize symbols are displayed, causing the plurality of edge lighting sections coupled to the at least one outer edge of the electronic gaming machine to display the edge lighting configuration associated with the prize.

9. The method of claim 8, further comprising:

displaying the electronic game including displaying a plurality of selectable symbols, the plurality of prizes, and a plurality of bonus meters, wherein each bonus meter of the plurality of bonus meters corresponds to and is displayed in association with at least one prize of the plurality of prizes;

receiving, from the interface device, a selection of a selectable symbol of the plurality of selectable symbols;

in response to the selection of the selectable symbol, updating the display device to display a prize symbol in place of the selectable symbol; and in response to updating the display device to display one of the prize symbols, controlling a prize amount to be displayed on the bonus meter of a prize corresponding to the displayed prize symbol.

10. The method of claim 9, further comprising:

revealing, in response to a plurality of selections of the plurality of selectable symbols, a plurality of prize symbols in place of each selected selectable symbol; and adding, in response to each revealing, a prize amount to the bonus meter of the prize corresponding to each revealed prize symbol, such that one of the plurality of bonus meters is incremented and accumulates value each time a prize symbol is revealed in place of a selectable symbol.

11. The method of claim 9, further comprising:

controlling a random number generator (RNG) to generate an RNG output;

randomly selecting a weighted table from a plurality of weighted tables stored in the memory device;

performing a lookup in a weighted table of prize symbols stored in the memory device; and based upon at least the RNG output and the lookup, determining the one of the prize symbols to display in place of the selectable symbol.

12. The method of claim 9, further comprising causing display, by the game controller and on the display device, of the plurality of selectable symbols as part of the electronic game comprising a bonus game that is triggered from a base game, and wherein, in the base game, the method further comprises:

displaying, on the display device, a plurality of symbols from a plurality of reels;

evaluating the plurality of symbols displayed from the plurality of reels to determine whether at least one symbol displayed from at least one reel is a wild symbol, and one of:

in response to determining that the at least one symbol from the at least one reel is a wild symbol, and if a trigger condition occurs: replacing all of the symbols displayed from the at least one reel with wild symbols, such that the wild symbol displayed from the at least one reel appears to expand to populate the remainder of the at least one reel; or in response to determining that the at least one symbol from the at least one reel is a wild symbol, and if the trigger condition does not occur: updating a graphic asset displayed on the display such that a value associated with the graphic asset increases, and such that the graphic asset appears to increase in one of size or value.

13. The method of claim 9, further comprising controlling display, on the display device, of the plurality of selectable symbols as part of a bonus game that is triggered from a base game.

14. The method of claim 8, further comprising controlling, by the game controller, an edge lighting effect based upon a number of wild symbols displayed during a base game.

15. A gaming system comprising:

a display device;

an interface device;

a plurality of independently controllable edge lighting sections coupled to at least one outer edge of the display device;

a memory device storing a required number of trigger conditions; and a server system comprising a processor configured to execute instructions stored on the memory device, which, when executed by the processor, cause the processor to:

determine, based upon a plurality of results, a number of trigger conditions that are met;

for each of the number of trigger conditions that are met, cause a corresponding section of the plurality of edge lighting sections coupled to the at least one outer edge of the display device to light up;

determine when the number of the trigger conditions that are met reaches a required number of trigger conditions;

in response to determining the number of trigger conditions that are met reaches the required number of trigger conditions, control the display device to display an electronic game;

determine that at least a predefined number of prize symbols corresponding to a prize of a plurality of prizes are displayed on the display device during the electronic game, wherein each prize is associated in the memory device with an edge lighting configuration; and in response to determining that the predefined number of prize symbols are displayed, cause the plurality of edge lighting sections coupled to the at least one outer edge of the electronic gaming machine to display the edge lighting configuration associated with the prize.

16. The gaming system of claim 15, wherein the instructions, when executed by the processor, further cause the processor to:

display the electronic game including display of a plurality of selectable symbols, a plurality of prizes, and a plurality of bonus meters, wherein each bonus meter of the plurality of bonus meters corresponds to and is displayed in association with at least one prize of the plurality of prizes;

receive, from the interface device, a selection of a selectable symbol of the plurality of selectable symbols;

in response to the selection of the selectable symbol, update the display device to display a prize symbol in place of the selectable symbol; and in response to updating the display device to display one of the prize symbols, control a prize amount to be displayed on the bonus meter of a prize corresponding to the displayed prize symbol.

17. The gaming system of claim 16, wherein the instructions, when executed by the processor, further cause the processor to:

reveal, in response to a plurality of selections of the plurality of selectable symbols, a plurality of prize symbols in place of each selected selectable symbol; and add, in response to each revealing, a prize amount to the bonus meter of the prize corresponding to each revealed prize symbol, such that one of the plurality of bonus meters is incremented and accumulates value each time a prize symbol is revealed in place of a selectable symbol.

18. The gaming system of claim 16, wherein the gaming system further comprises a random number generator (RNG), and wherein the instructions, when executed by the processor, further cause the processor to:

control the RNG to generate an RNG output;

randomly select a weighted table from a plurality of weighted tables stored in the memory device;

perform a lookup in a weighted table of prize symbols stored in the memory device; and based upon at least the RNG output and the lookup, determine the one of the prize symbols to display in place of the selectable symbol.

19. The gaming system of claim 16, wherein the instructions, when executed by the processor, further cause the processor to cause display of the plurality of selectable symbols as part of the electronic game comprising a bonus game that is triggered from a base game, and wherein, in the base game, the instructions, when executed by the game controller, further cause the game controller to:

display a plurality of symbols from a plurality of reels;

evaluate the plurality of symbols displayed from the plurality of reels to determine whether at least one symbol displayed from at least one reel is a wild symbol, and one of:

in response to determining that the at least one symbol from the at least one reel is a wild symbol, and if a trigger condition occurs: replace all of the symbols displayed from the at least one reel with wild symbols, such that the wild symbol displayed from the at least one reel appears to expand to populate the remainder of the at least one reel; or in response to determining that the at least one symbol from the at least one reel is a wild symbol, and if the trigger condition does not occur: update a graphic asset displayed on the display such that a value associated with the graphic asset increases, and such that the graphic asset appears to increase in one of size or value.

20. The gaming system of claim 19, wherein the instructions, when executed by the processor, further cause the processor to control an edge lighting effect of the edge lighting based upon a number of wild symbols displayed during the base game.

* * * * *